US012104375B2

(12) United States Patent
Chapman

(10) Patent No.: US 12,104,375 B2
(45) Date of Patent: Oct. 1, 2024

(54) CONCRETE FORM ASSEMBLY

(71) Applicant: Logix Brands Ltd., Port Hope (CA)

(72) Inventor: Kurtis Chapman, Toronto (CA)

(73) Assignee: LOGIX BRANDS LTD., Port Hope (CA)

( * ) Notice: Subject to any disclaimer, the term of this patent is extended or adjusted under 35 U.S.C. 154(b) by 234 days.

(21) Appl. No.: 17/833,588

(22) Filed: Jun. 6, 2022

(65) Prior Publication Data

US 2022/0298785 A1 Sep. 22, 2022

Related U.S. Application Data

(63) Continuation-in-part of application No. 17/668,082, filed on Feb. 9, 2022, which is a continuation-in-part of application No. 17/188,618, filed on Mar. 1, 2021, now Pat. No. 11,668,089.

(51) Int. Cl.
*E04B 2/86* (2006.01)

(52) U.S. Cl.
CPC ..... *E04B 2/8652* (2013.01)

(58) Field of Classification Search
CPC ..... E04B 2/86; E04B 2/8611; E04B 2/8617; E04B 2/8635; E04B 2/8652; E04B 2/8641
See application file for complete search history.

(56) References Cited

U.S. PATENT DOCUMENTS 5,409,193 A 4/1995 Baxter
5,744,076 A 4/1998 Baxter
6,308,484 B1 10/2001 Severino
6,314,697 B1 11/2001 Moore, Jr.
6,318,040 B1 11/2001 Moore, Jr.
6,336,301 B1 * 1/2002 Moore, Jr. ..... E04B 2/8635 52/426
6,636,683 B2 10/2003 Morimoto et al.
6,668,503 B2 12/2003 Beliveau
6,792,729 B2 9/2004 Beliveau
6,945,506 B2 9/2005 Long, Sr.
7,415,804 B2 8/2008 Coombs et al.
D614,941 S 5/2010 Murphy
7,810,293 B2 10/2010 Gibbar et al.
7,818,935 B2 10/2010 Velickovie
7,827,752 B2 * 11/2010 Scherrer ..... E04B 2/8641 52/426
8,037,652 B2 10/2011 Marshall et al.
(Continued)

FOREIGN PATENT DOCUMENTS

CA 2801735 7/2013
EP 2010734 7/2009
(Continued)

*Primary Examiner* — Christine T Cajilig

(74) *Attorney, Agent, or Firm* — Bradley J. Thorson; DeWitt LLP

(57) ABSTRACT

Concrete form assemblies having insulating foam panels are created using locking members embedded within the insulating foam panels and ties each having a pair of side rails for coupling two insulating foam panels together at a predetermined distance apart, the locking members and side rails being adapted so that either side rail can be coupled to either locking member and either of the ends of the rails and locking members can be toward the top or bottom of the assembly when the rails are coupled to the locking members.

20 Claims, 26 Drawing Sheets

(56) References Cited

U.S. PATENT DOCUMENTS

| | | | | |
|---|---|---|---|---|
| 8,096,094 | B2 | 1/2012 | Mees | |
| 9,033,303 | B2 | 5/2015 | McDonagh | |
| 9,038,338 | B2 | 5/2015 | Rice | |
| 9,074,379 | B2 | 7/2015 | Ciuperca | |
| 9,157,233 | B2 * | 10/2015 | Gosain | E04B 2/8647 |
| 10,167,633 | B2 | 1/2019 | Foderberg et al. | |
| 2005/0028466 | A1 * | 2/2005 | Titishov | E04B 2/8617<br>52/474 |
| 2005/0155306 | A1 | 7/2005 | Childres | |
| 2007/0209310 | A1 | 9/2007 | Papke | |
| 2012/0096797 | A1 | 4/2012 | Garrett | |
| 2013/0180192 | A1 * | 7/2013 | Crosby | E04B 2/8635<br>52/426 |
| 2015/0089894 | A1 | 4/2015 | Ryan | |
| 2018/0112400 | A1 | 4/2018 | Dajnko | |
| 2019/0093348 | A1 | 3/2019 | Robak | |

FOREIGN PATENT DOCUMENTS

| | | | | |
|---|---|---|---|---|
| FR | 3004482 | A1 * | 10/2014 | E04B 2/8652 |
| GB | 2458317 | A | 9/2009 | |
| WO | 9523899 | A1 | 9/1995 | |
| WO | 2010047919 | | 4/2010 | |
| WO | WO-2011058593 | A1 * | 5/2011 | E04B 2/86 |
| WO | 2015059594 | | 4/2015 | |

* cited by examiner

CONCRETE FORM ASSEMBLY

CROSS-REFERENCED TO RELATED APPLICATIONS

This application is a continuation-in-part of U.S. patent application Ser. No. 17/668,082 filed on Feb. 9, 2022, which is a continuation-in-part of U.S. patent application Ser. No. 17/188,618 filed Mar. 1, 2021.

STATEMENT REGARDING FEDERALLY SPONSORED RESEARCH OR DEVELOPMENT

Not applicable.

BACKGROUND OF THE INVENTION

I. Field of the Invention

The present invention relates generally to concrete forms. More specifically, the present invention relates to a locking and tie system for forming insulated forms used in the manufacture of concrete walls and the like.

II. Related Art

Many buildings are constructed on concrete foundation walls. Sometimes these concrete foundation walls are formed of precast concrete blocks. At other times, these concrete foundation walls are formed by assembling forms and then pouring concrete into the assembled forms.

Assembling such forms is often a laborious task involving the use of expensive materials such as metal or wood. Forms made of metal are very heavy and extremely labor-intensive to assemble and remove after pouring the concrete.

More recently, insulated concrete forms have been used. Insulated concrete forms are constructed of insulated panels, e.g., panels made of expanded polystyrene, which are connected in parallel using a series of rigid ties to form blocks. The blocks are then stacked or otherwise positioned to complete the form. Concrete is then poured between the panels.

Different sized ties may be employed to adjust the resulting thickness of the poured concrete wall. Even after the concrete has cured, the foam panels are typically left in place, rather than removed, to assist in insulating the building.

Significant problems exist with the insulated concrete forms presently available in the marketplace. Most are made with fixed webs and come to a job site as fully assembled blocks. These fully assembled blocks take up a lot of room and create inefficiencies for storage, shipping, and handling.

There are also problems with existing concrete form systems that come to the job site unassembled (i.e., knock down insulated concrete forms). Existing knockdown insulated concrete forms take time to assemble on site, and the components do not lock into place properly. The components will bear more concrete and rebar weight only when oriented in a specified fashion, thus requiring the blocks themselves to be oriented in a specific manner. The components fail to stay properly assembled and fail to provide sufficient form strength. This is particularly true when they are cut in half, which can happen often to facilitate window and door opening placement.

The components of knockdown insulated concrete forms presently available in the marketplace are neither interchangeable nor reversable. Instead, they have a top and bottom and some have a left and a right orientation required for proper assembly. This creates inefficiency when assembling the forms.

Further, such systems result in inefficient use of materials, increased manufacturing costs, increased shipping costs, and increased space requirements for storage and transportation. Some require the blocks be assembled on the wall being built. This means the blocks cannot be pre-assembled elsewhere and carried as an assembled unit.

Thus, there exists a need for knockdown insulated concrete forms which ship flat, fill a truck well, are easy to store, easy to handle, easy to assemble at the job site, and are sturdy enough so they do not inadvertently come apart during assembly, installation of rebar or pouring of concrete into the form.

SUMMARY OF THE INVENTION

The present invention solves the foregoing problems by providing concrete form assemblies, each comprising a first locking member, a second locking member, and a tie. The ties have no top or bottom, left or right. Likewise, the locking members have no top or bottom. As such, the components ship flat, fill a truck well, are easy to store, easy to handle, and easy to assemble into sturdy blocks and then into an insulated concrete form at the job site. Such blocks may be cut in half to facilitate window and door opening placement. Such forms are also sufficiently sturdy to handle the forces normally encountered when installing rebar within the form and pouring concrete into the form.

Each of the locking members has an inner plate with an inside surface and an outside surface, an outer plate, and a plurality of struts extending between the outside surface of the inner plate and the outer plate. The struts are adapted to hold the inner plate and outer plate in spaced relation relative to each other.

A first row of teeth and a second row of teeth project from the inside surface of the inner plate of each of the locking members. The second row of teeth is spaced from the first row of teeth. Each tooth of the first row of teeth has an inner surface, and a recess between the inside surface of the inner plate and the inner surface of the tooth. This recess is open toward the second row of teeth. Likewise, each tooth of the second row of teeth has an inner surface, and a recess between the inside surface of the inner plate and the inner surface of the tooth. This recess is open toward the first row of teeth. Additionally, each row of teeth has a pair of end teeth. These end teeth include notches facing away from the other teeth of the row.

The first and second locking members are interchangeable, i.e., either can be attached to the left or right side of the tie. Also, the first and second locking members are reversable, i.e., either end of a locking member can face up or down.

The tie comprises a first rail and a second rail, and at least one bridging member extending between the first rail and the second rail holding the first rail and second rail a predetermined distance apart. Each of these rails is configured like an I-beam having an outer rail member, an inner rail member, a connecting member. Each rail also includes at least one locking tab at each end of the rail. As such, the tie is reversable both horizontally and vertically such that the tie has no predetermined top or bottom or left or right side.

The tie is adapted so that the first rail can be coupled to one of the locking members and the second rail can be coupled to the other of the locking members. Such a connection between a rail of the tie and either of the locking members is made by aligning the tie with the locking member so that the connecting member of the rail is between the first row of teeth and the second row of teeth of the locking member, the outer rail member of the tie is aligned with channels formed by the recesses in the teeth of the locking member, and the inner rail member of the tie is just inside of the inner surfaces of the teeth of the locking member. The tie and locking member are then slid together. As this occurs, the connecting member slides between the two rows of teeth, the outer rail member of that rail slides through and is captured within the recesses of the teeth of both the first and second rows of teeth of the locking member, and the inner rail member slides across and engages the inner surface of the teeth of both the first and second rows of teeth of the locking member. When the leading end of the rail is slid all the way across the locking member, the tabs engage the notches of the end teeth at both ends of the locking member preventing movement of the tie relative to the locking member. The tie can be attached to another locking member in this same way.

Significantly, the tie has no top, bottom, left or right orientation. This eases assembly. Likewise, neither locking member must be positioned on a specific end of the tie, and the locking members have no top or bottom.

The locking members are adapted to be embedded in the insulative foam material from which the panels are formed. In most cases these panels will be formed with the foam material filling the spaces between the struts and the outside surface of the inner plate and the outer plate. This serves to couple the locking member to the panels. Further, the panels have an inside panel surface defining a plane. The panel is formed to include a channel extending from this plane to the inner plate of the locking member. This channel is deep enough so that the teeth are substantially co-planar with the inside panel surface. This allows the panels to be prefabricated with the locking members fixed in place and easily stacked for transport and storage. Of course, the channel is wide enough so that the foam material does not interfere with coupling the tie to the locking member, as described above.

The tie is dimensioned to hold two connected insulated panels a predetermined distance apart. By way of example, and without limitation, this distance may be 4 inches, 6 inches, 8 inches, 10 inches or 12 inches apart. Likewise, the locking members and ties may be dimensioned to accommodate panels of different dimensions. By way of example, and without limitation, the panels may be 12 inches by 12 inches, or 16 inches by 16 inches. Longer panels, such as 12 inches by 48 inches and 16 inches by 48 inches provide efficient construction of forms.

Ideally each locking member and each tie is formed of a single piece of a suitable plastic material. The selected plastic material should allow the panels to be assembled into blocks using the locking members and ties. These blocks, once assembled, can be used in any direction with the same amount of strength regardless of orientation. The locking tabs on the two ends of the rails of the tie described above are two-way and allow the tie to be inserted in any direction. There is no predetermined top or bottom and there is no predetermined left or right side to the center tie.

Additionally, the notches in the end teeth of the locking members allow the locking tabs to resist downward pressure. As downward pressure is applied to the center tie, the locking tabs wedge in place providing sufficient strength to allow the assembly to hold rebar and resist the outward forces applied as concrete is poured into the form.

There are scenarios in which cutting a block of a form in half is desirable, such as to provide window and door openings. As such, the ties and locking members are scored or are otherwise designed to be easily separated into two pieces. Other embodiments of the ties and locking members may be scored or otherwise designed to be easily separated into more than two pieces without deviating from the invention. When a block is to be cut in half horizontally, a center bridging member is inserted, and an additional bridging member is broken at the score line. Half of the broken bridging member is inserted in the top, and the other half of the broken bridging member is inserted in the bottom. As such, when the block is cut in half through the center bridging member, each half of the block includes half of the center bridging member and half of the broken bridging member which cooperate to hold the half block together. As such, the half block will sit properly in position when the blocks are stacked, providing form support for the concrete pour, and fastening surfaces for the finishes after the wall is poured with concrete.

Once a block is assembled, the tie is locked in place with respect to the two locking members in all directions. As such, the now-assembled block can (1) be confidently handled as a unit, and (2) the now-assembled block can be also considered to have no left or right, top or bottom, once again increasing efficiency when placing the block to create the form. In particular, the ties of the blocks will bear the weight of concrete and rebar equally well, regardless of orientation.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
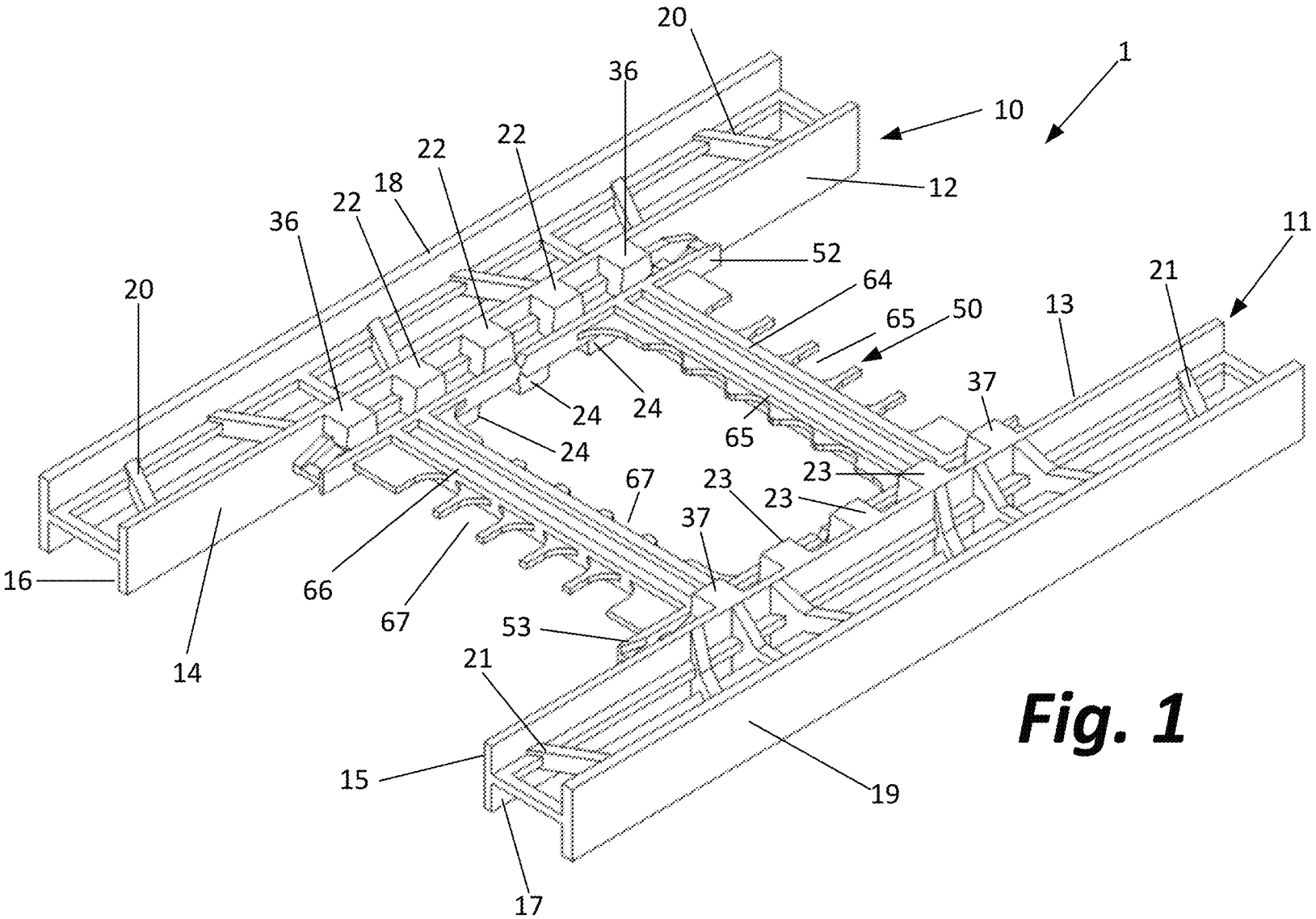
FIG. 1 is a perspective view of a tie and two locking members of a concrete form assembly, all made in accordance with the present invention and connected.

This description of the preferred embodiment is intended to be read in connection with the accompanying drawings, which are to be considered part of the entire written description of this invention. In the description, relative terms such as "lower", "upper", "horizontal", "vertical", "above", "below", "up", "down", "top" and "bottom", "under", as well as derivatives thereof (e.g., "horizontally", "downwardly", "upwardly", "underside", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "joined", and "joining" are used interchangeably and refer to one structure or surface being secured to another structure or surface or integrally fabricated in one piece unless expressly described otherwise.

FIGS. 1-15 show an insulated concrete form support assembly 1 comprising a first locking member 10, a second locking member 11, and a tie 50. The first locking member 10 and the second locking member 11 are constructed in an identical manner and are preferably each molded as a single piece from a suitable thermoplastic polymer such as recycled polypropylene. Other thermoplastic materials such as virgin polypropylene, polyethylene, polypropylene, polyvinyl chloride, acrylonitrile butadiene styrene, polycarbonate, or polyamide may be used without deviating from the invention. The tie 50 is also preferably molded as a single piece from such a thermoplastic polymer.

The locking members 10/11 have an inner plate 12/13. The inner plate 12/13 has an inside surface 14/15 and an outside surface 16/17. The locking members also have an outer plate 18/19. The inner plate 12/13 and the outer plate 18/19 are fixed together in a parallel spaced relation by a series of struts 20/21. More specifically, the struts 20/21 are coupled at one end to the outer plate 18/19 and at another end to the outside surface 16/17 of the inner plate 12/13. The struts 20/21, the outer plate 18/19 and the inner plate 12/13 combine to define a series of spaces 44/45.

Two rows of teeth project from the inside surface 14/15 of the inner plate 12/13. As shown in the drawings, inside surface 14 has a first row of teeth 22 and a second row of teeth 24 separated by a gap 26 while inside surface 15 has a first row of teeth 23 and a second row of teeth 25 separated by a gap 27.

Each of the teeth have certain features in common. All the teeth have an inner surface. More specifically, locking member 10 has a first row of teeth 22 having inner surfaces 28, and a second row of teeth 24 having inner surfaces 32. Likewise, locking member 11 has a first row of teeth 23 having inner surfaces 29 and a second row of teeth 25 having inner surfaces 33.

Figure 12:
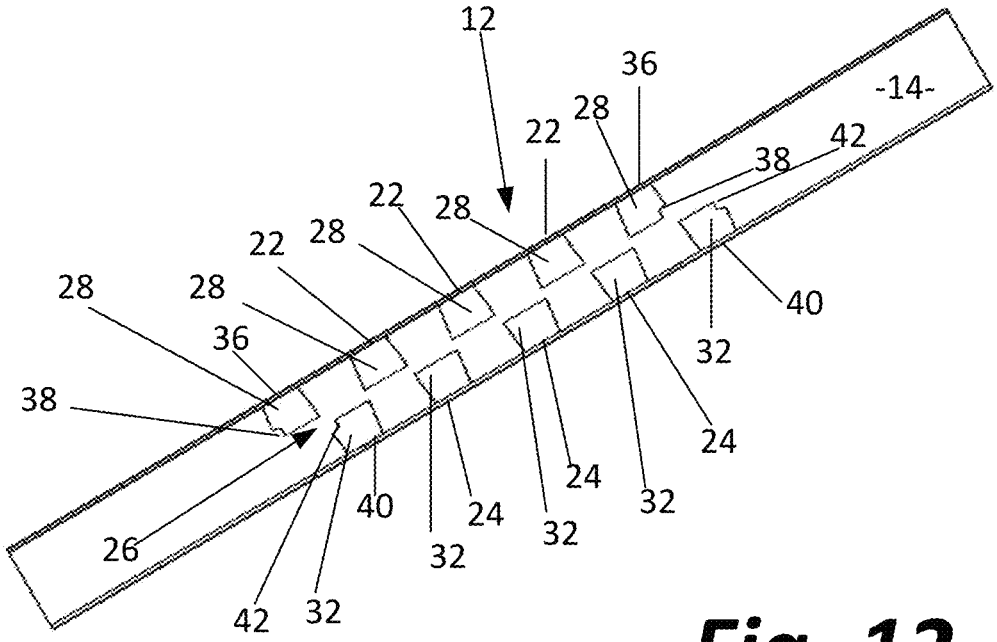
FIG. 12 is a side plan view of the locking member of FIG. 4.

Each tooth also includes a recess or cavity positioned between the inside surface of the inner plate and the inner surface of the tooth. More specifically, each tooth of first row 22 of the first locking member 10 has a recess 30 between the inside surface 14 of inner plate 12 and the inner surface 28 of the tooth, and each tooth of second row 24 of the first locking member 10 has a recess 34 between the inside surface 14 of the inner plate 12 and the inner surface 32 of the tooth. It is important to note that the recesses 30 in the teeth of the first row of teeth 22 are open toward the second row of teeth 24. Likewise, the recesses 34 in the teeth of the second row of teeth 24 are open toward the first row of teeth 22. Further, the teeth of the first row of teeth 22 are offset from the second row of teeth 24 as best shown in FIG. 12. In other words, the teeth of one row are aligned with spaces between the teeth of the other row.

Figure 13:
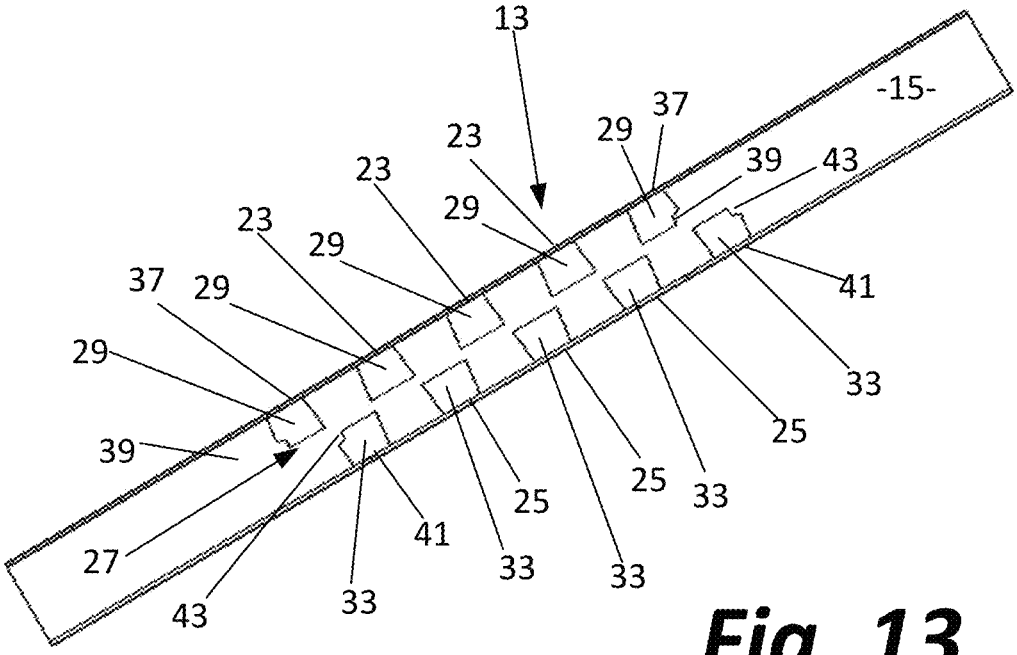
FIG. 13 is a side plan view of the locking member of FIG. 7.

As indicated above, the two locking members 10 and 11 are constructed in an identical fashion. As such, each tooth of first row 23 of the second locking member 11 has a recess 31 between the inside surface 15 of inner plate 13 and the inner surface 29 of the tooth, and each tooth of second row 25 of the second locking member 11 has a recess 35 between the inside surface 15 of the inner plate 13 and the inner surface 33 of the tooth. The recesses 31 in the teeth of the first row of teeth 23 are open toward the second row of teeth 25. Likewise, the recesses 35 in the teeth of the second row of teeth 25 are open toward the first row of teeth 23. Further, the teeth of the first row of teeth 22 are offset from the second row of teeth 25 as shown in FIG. 13.

Each of the rows of teeth have two end teeth, one at each end of the row. Each of the end teeth is notched. In row 22, the end teeth are labeled 36 and the notches in the end teeth 36 are labeled 38. In row 23, the end teeth are labeled 37 and the notches in the end teeth 37 are labeled 39. In row 24, the end teeth are labeled 40 and the notches in the end teeth 40 are labeled 42. In row 25, the end teeth are labeled 41 and the notches in the end teeth 41 are labeled 43. Other teeth may be notched as well without deviating from the invention. These notches in the end teeth extend into the tooth from the tooth's inner surface on the outside of the end tooth such that each notch in an end tooth faces away from the other teeth in the same row as the end tooth.

Sometimes it is advantageous to split a locking member 10/11 into two. As such, the locking members 10/11 may be scored, i.e., provided with an area of reduced thickness, to accommodate splitting the locking member in two. When this is the case, the four teeth (the two in each of the two rows on opposing sides of the score) immediately adjacent the scoring may be notched. These notches extend into the tooth from the tooth's inner surface and face toward the score.

Figure 2:
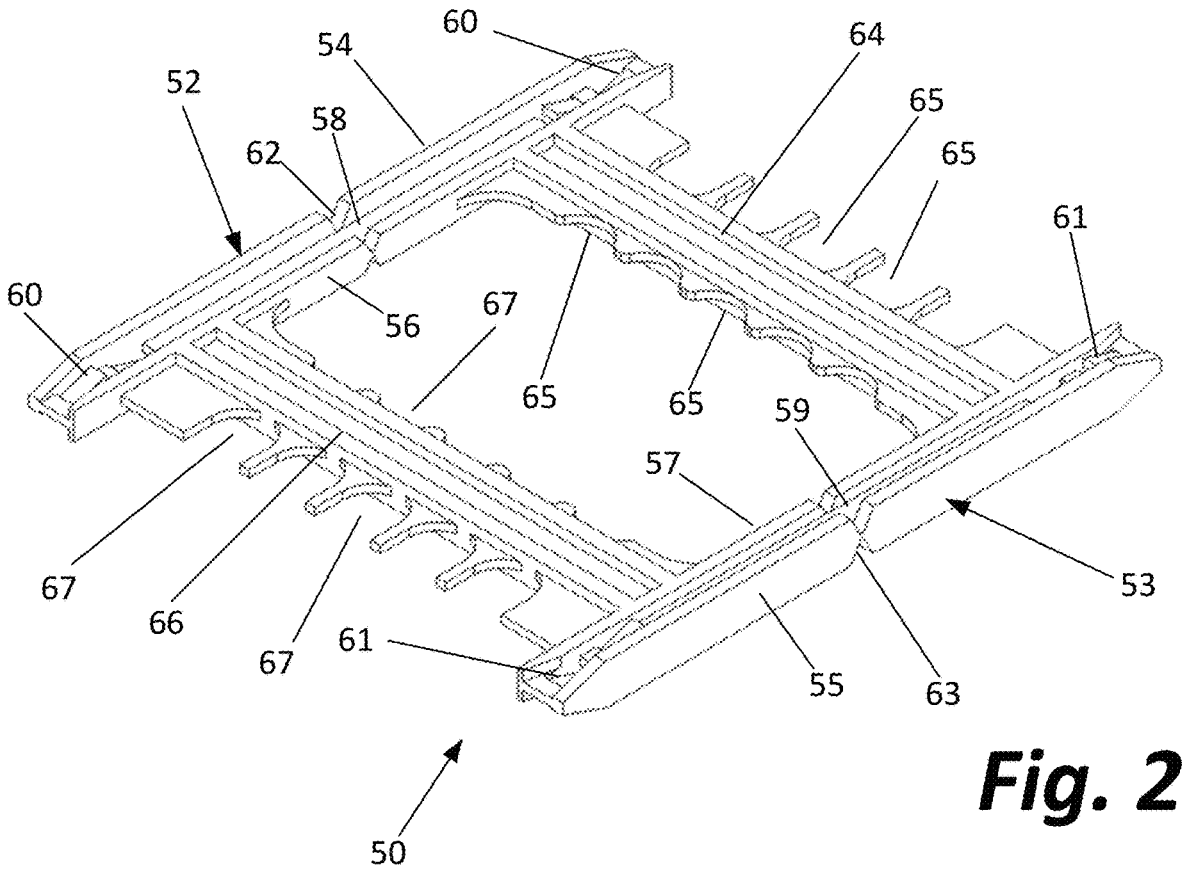
FIG. 2 is a perspective view of the tie of FIG. 1.
Figure 3:
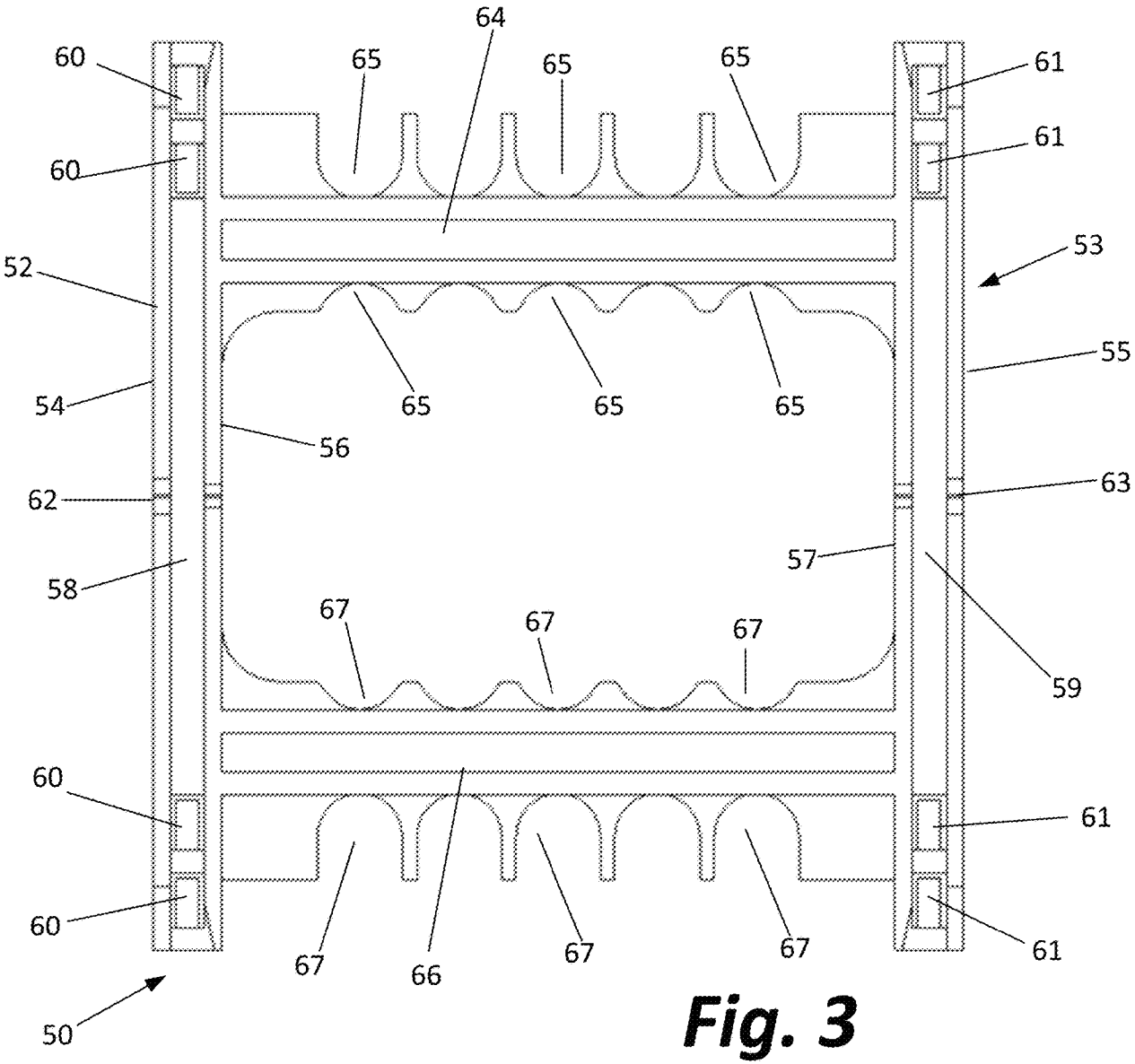
FIG. 3 is a front plan view of the tie of FIG. 1.
Figure 4:
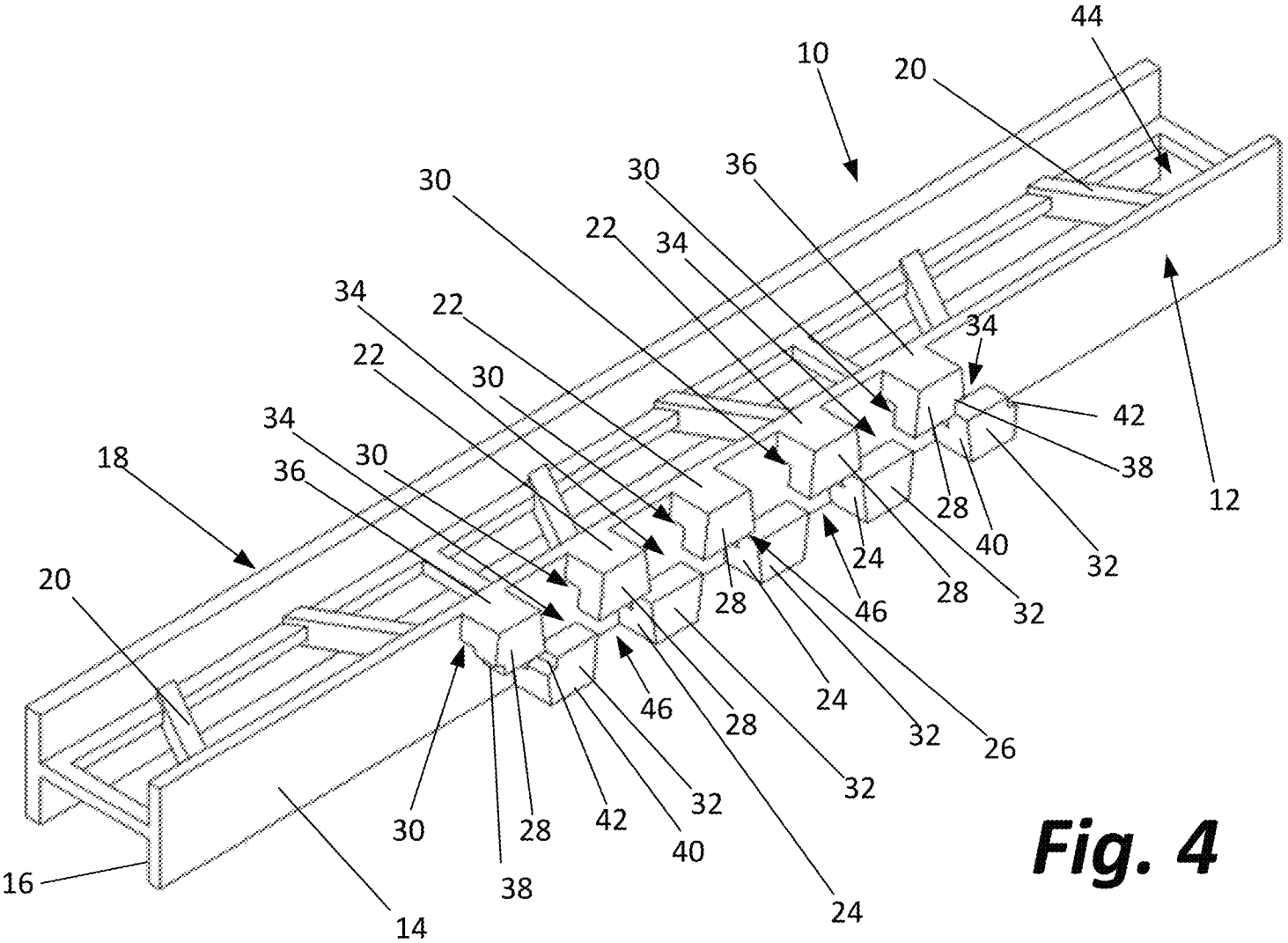
FIG. 4 is perspective view of one of the locking members of FIG. 1.
Figure 5:
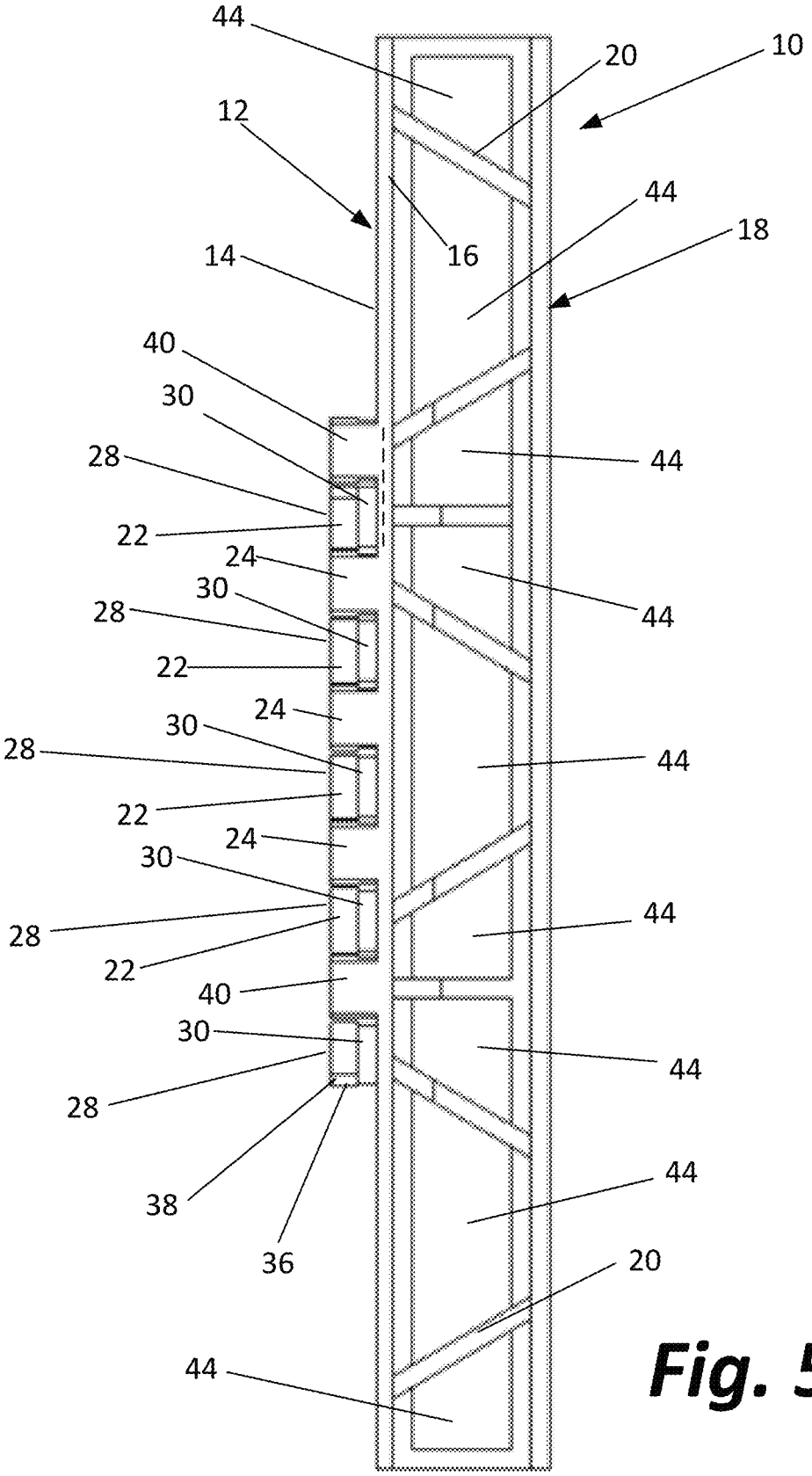
FIG. 5 is a front plan view of the locking member of FIG. 4.
Figure 6:
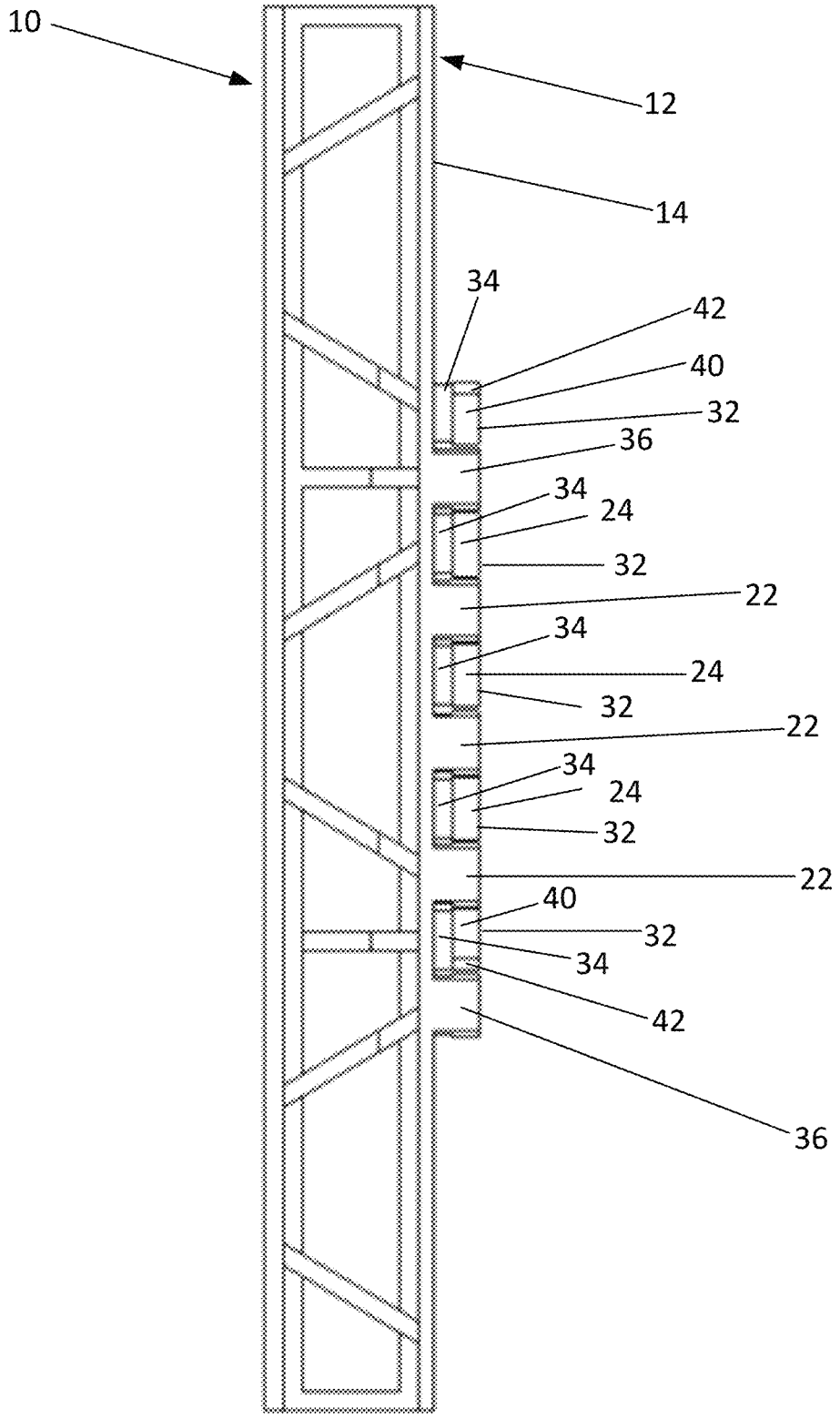
FIG. 6 is rear plan view of the locking member of FIG. 4.
Figure 7:
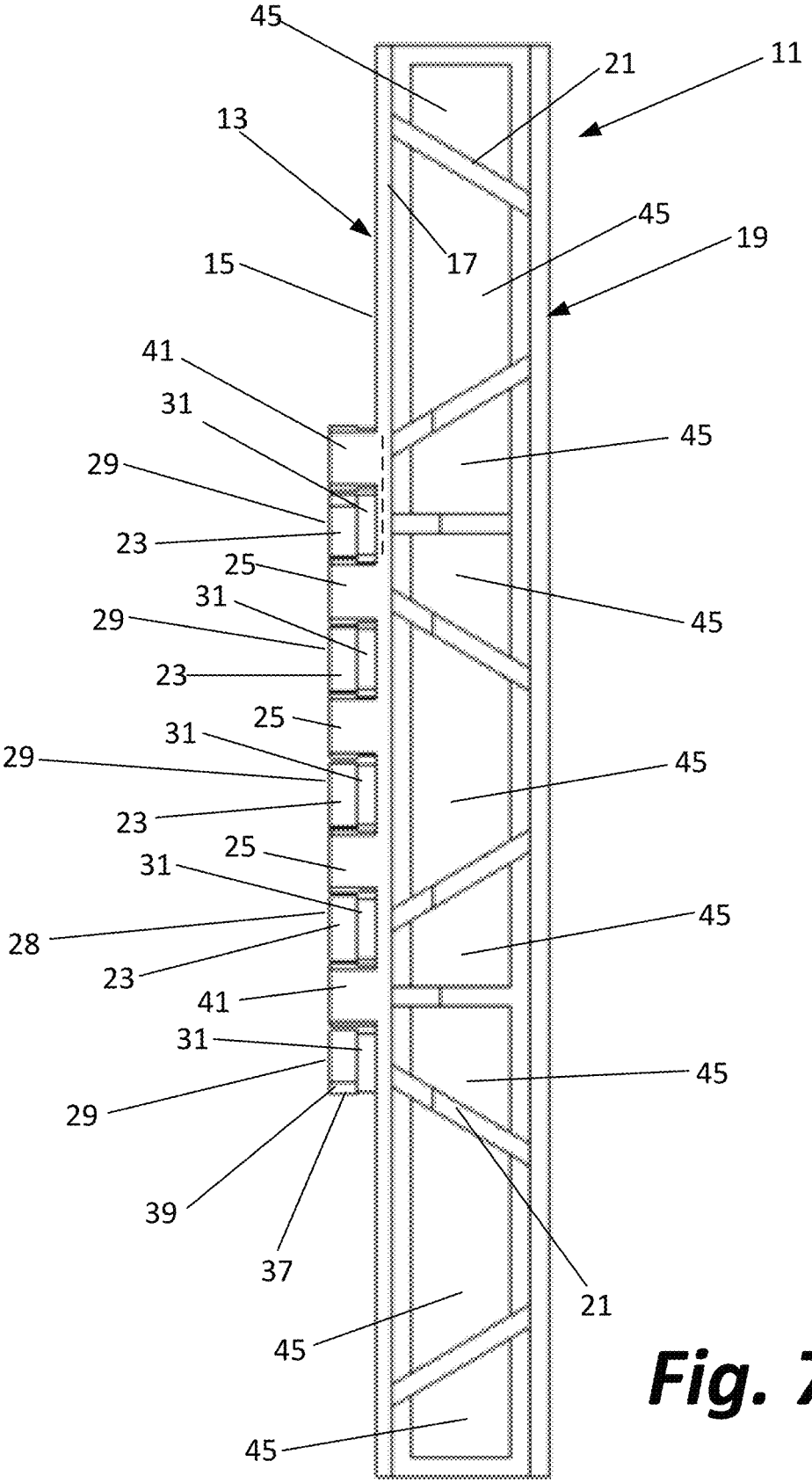
FIG. 7 is front plan view of the other of the locking members of FIG. 1.
Figure 8:
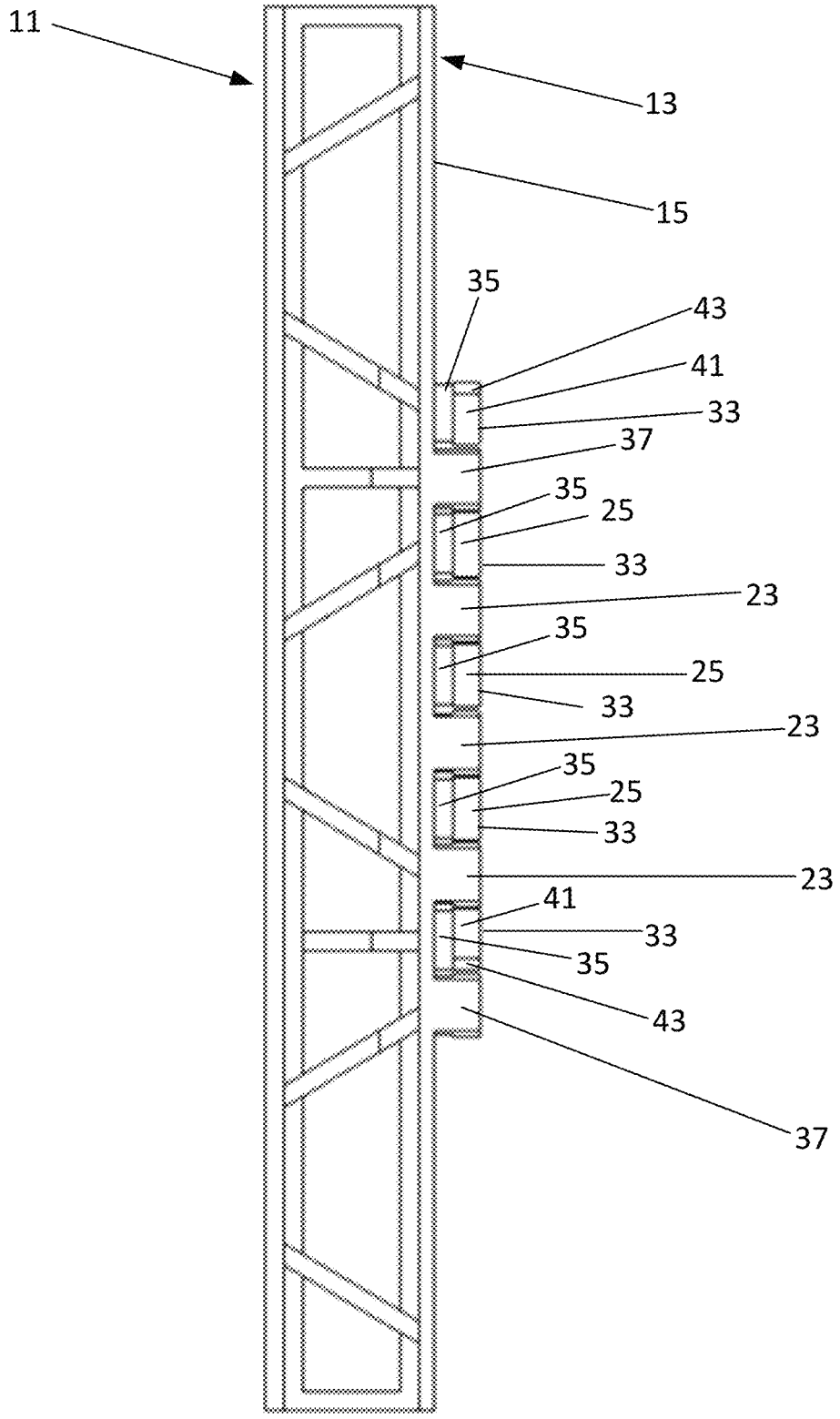
FIG. 8 is a rear plan view of the locking member of FIG. 7.
Figure 9:
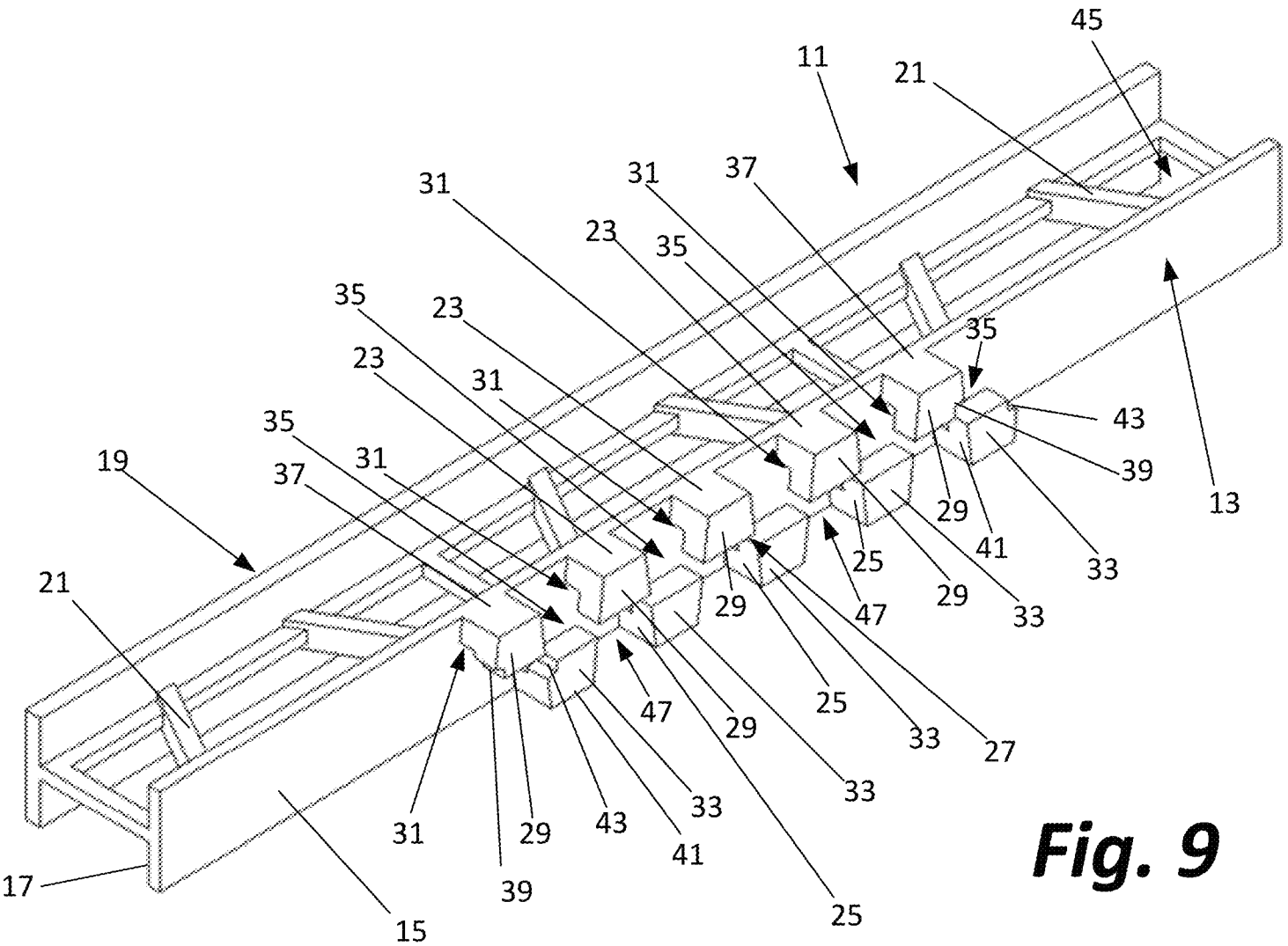
FIG. 9 is a perspective view of the locking member of FIG. 7.
Figure 10:
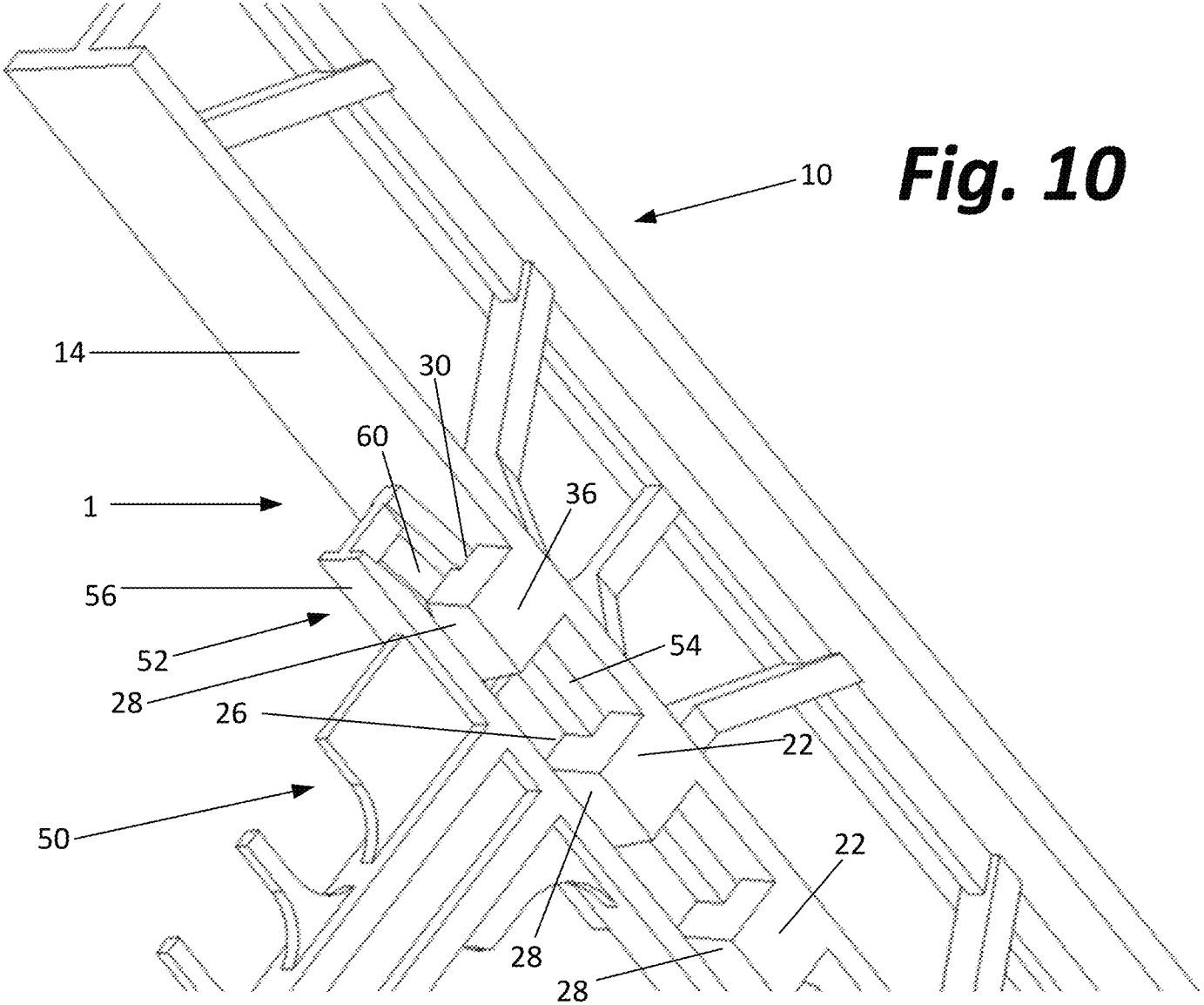
FIG. 10 is a first partial perspective view of the assembly of FIG. 1.
Figure 11:
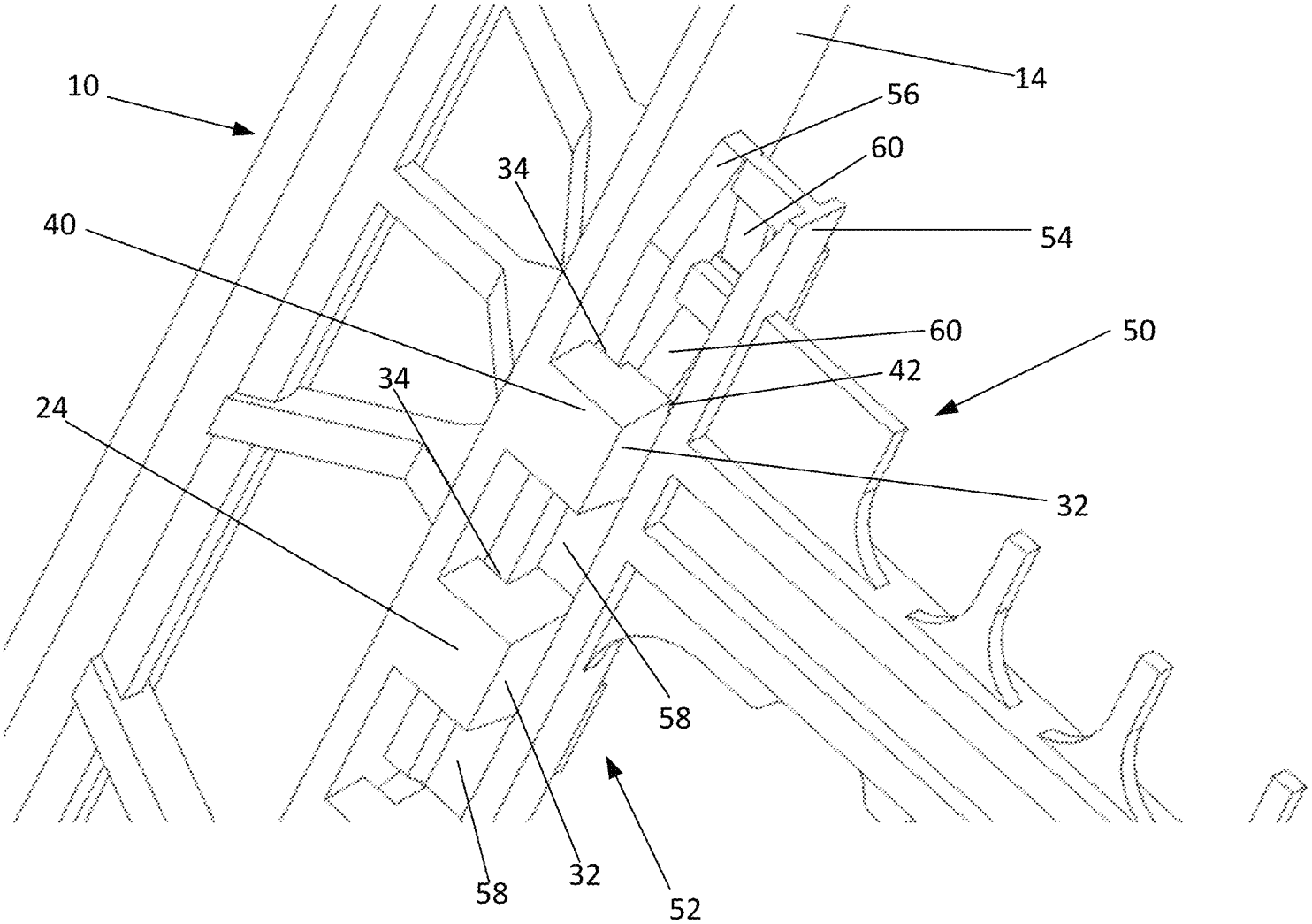
FIG. 11 is a second partial perspective view of the assembly of FIG. 1.

An exemplary tie 50 is best shown in FIGS. 2 and 3. The tie 50 include as first rail 52, a second rail 53, and two bridging members 64 and 66. The bridging members 64 and 66 are fixed to the rails 52 and 53 and hold the rails 52 and 53 parallel to each other a predetermined distance apart. Each rail is shaped like an I-beam. More specifically, the first rail 52 includes an outer rail member 54, and inner rail member 56, and a connecting member 58 joining the outer rail member 54 to the inner rail member 56 and holding these rail members 54 and 56 parallel to each other a fixed distance apart, while the second rail 53 includes an outer rail member 55, and inner rail member 57 and a connecting member 59 joining the outer rail member 55 to the inner rail member 57 and holding these rail members 55 and 57 parallel to each other a fixed distance apart. The first rail 52 may include a score (a narrowed portion) 62 at various places along its length such as at the midpoint as showing in the drawings for reasons to be explained later. Likewise, the second rail 53 may include a score (a narrowed portion) 63 at various places along its length such as at the midpoint.

Locking tabs are provided at each end of each of the rails 52 and 53. Additional locking tabs may be provided adjacent a score in the rail. More specifically, locking tabs 60 are located at each end of rail 52 and locking tabs 61 are located adjacent each end of the rail 53. The tie further includes a pair of bridging members 64 and 66 extending between and holding the rails 52 and 53 parallel to each other and a fixed distance apart. The bridging members 64 and 66 may be provided with concave pathways 65 and 67 defined by tabs for reasons explained below.

Figure 14:
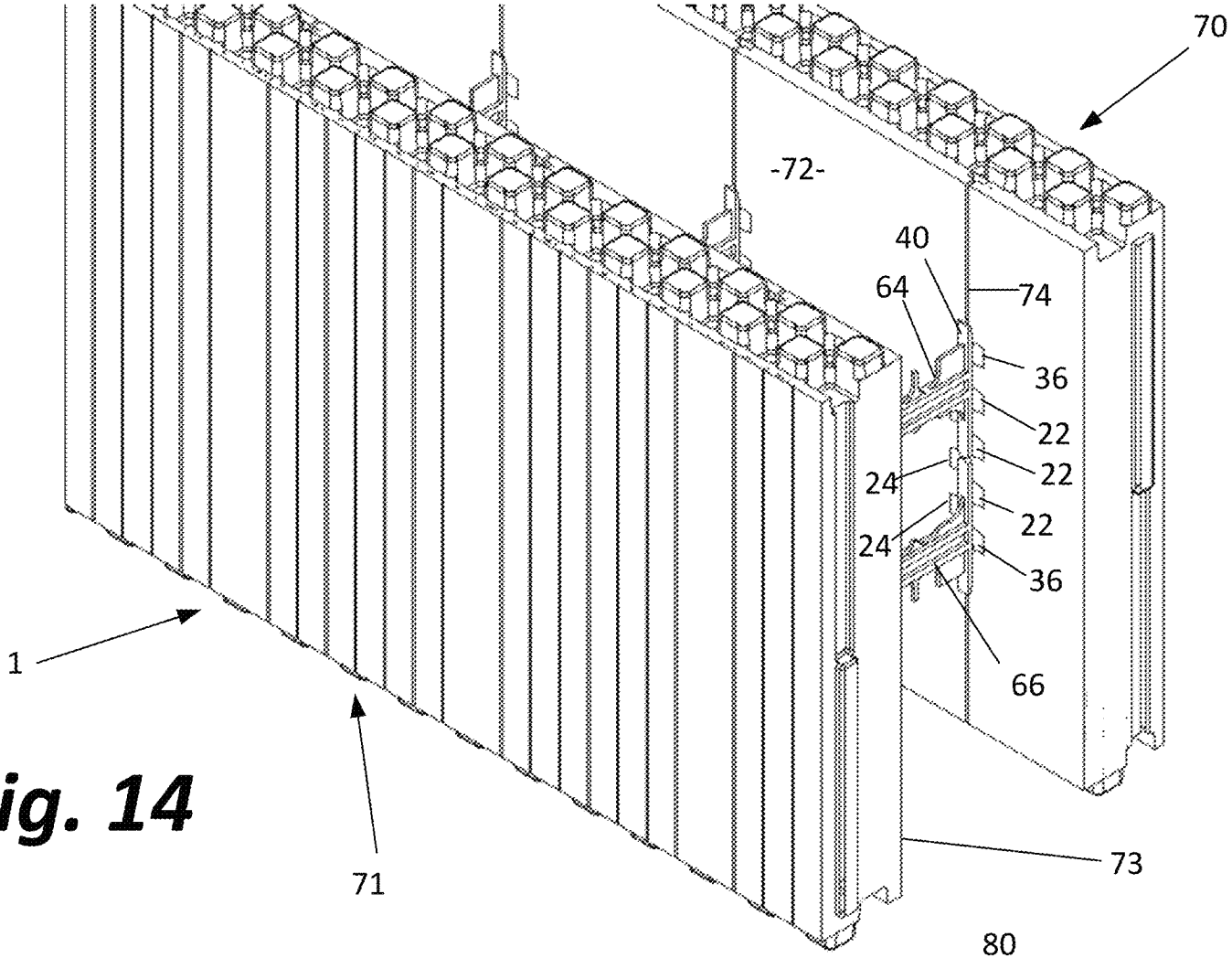
FIG. 14 is a first perspective view of a concrete form assembly made in accordance with the present invention.
Figure 15:
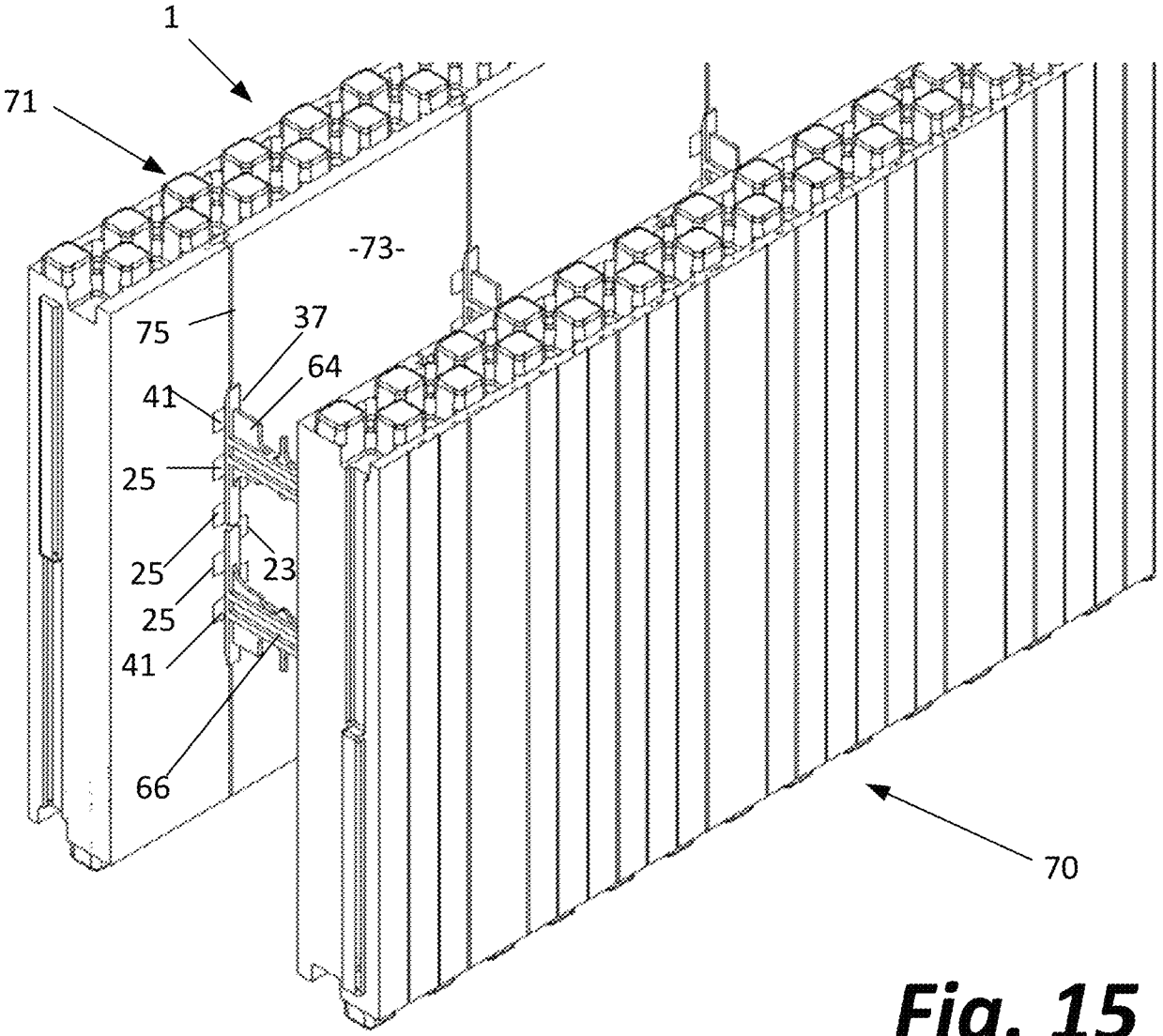
FIG. 15 is a second perspective view of the concrete form assembly of FIG. 14.
Figure 17:
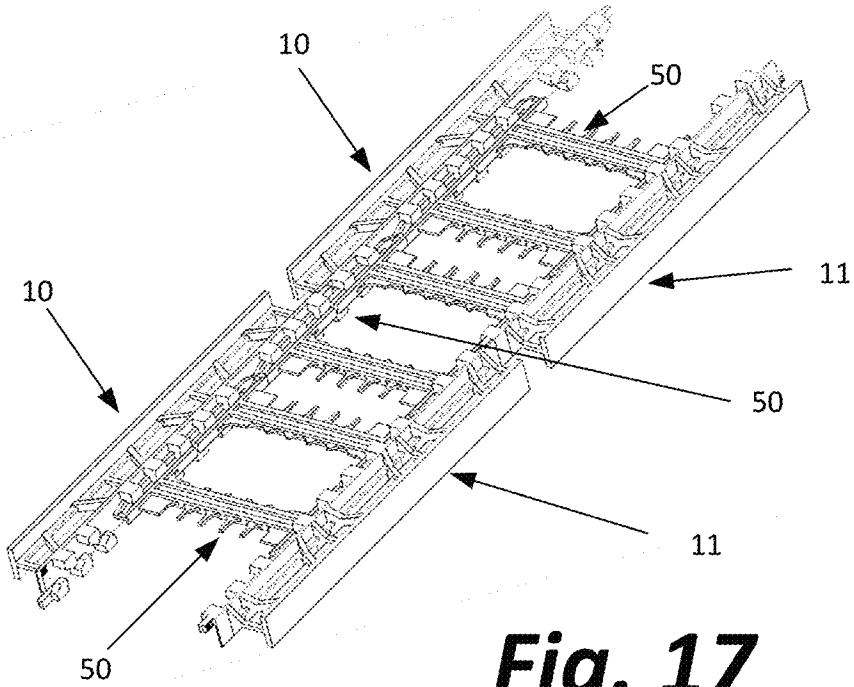
FIG. 17 is a perspective view showing the alternative locking members of FIG. 16 employed with multiple bridging members to create a longer and stronger assembly.

The insulated concrete form support assembly 1 described above is intended to be used with a pair of rugged foam insulating panels 70 and 71 to form blocks as shown in FIGS. 14 and 15 which are further assembled to create concrete forms.

The first locking member 10 is imbedded in the foam material as panel 70 is formed, and the second locking member 11 is embedded in the foam material as panel 71 is formed. The foam material flows through the spaces 44/45 defined by the struts 20/21, the inner plate 12/13 and the outer plate 18/19 of the locking members 10/11. The locking member 10 thus becomes fixed in place relative to the panel 70 and the locking member 11 becomes fixed in place relative to the panel 71 as the foam hardens and cures.

Panel 70 has an inside surface 72 defining a plane. Panel 70 also has a channel 74 extending inwardly from this plane to the inside surface 14 of the inner plate 12 of locking member 10. Channel 74 serves to expose the inside surface 14 and the two rows of teeth 22 and 24 of the locking member 10. The inner surfaces 28 of the teeth of the first row of teeth 22 and the inner surfaces 32 of the second row of teeth 24 are co-planar with, or slightly recessed from, the inside surface 72 of the panel 70.

Likewise, panel 71 has an inside surface 73 defining a plane. Panel 70 also has a channel 75 extending inwardly from this plane to the inside surface 15 of the inner plate 13 of the second locking member 11. Channel 75 exposes both the inside surface 13 and the two rows of teeth 23 and 25. The inner surfaces 29 of the teeth of the first row of teeth 23 and the inner surfaces 33 of the second row of teeth 25 of the second locking member 11 are co-planar with, or slightly recessed from, the inside surface 73 of the panel 70.

Such panels 70/71 are easily stacked for storage and transportation. This is because no portion of the locking member 10 extends beyond the inside surface 73 (or any other exterior surface) of the panel 70, and no portion of the locking member 11 extends beyond the inside surface 73 (or any other exterior surface) of the panel 71. This is also because the ties 50 may easily be joined to the locking members 10 and 11 in the field.

Two such panels 70/71 can be joined together to form a block to be used in constructing a concrete form by mating a tie 50 to the locking members 10 and 11 embedded in the panels 70/71. There are several ways to do so.

A first way is to begin by aligning the panels 70/71 on a rigid flat surface, so the two locking members 10/11 extend vertically and face each other. It makes no difference which end of either locking member 10 or 11 is up or down or which of the panels 70 and 71 is to the right or left.

Next, the rails 52 and 53 of tie 50 are positioned above the two locking members 10 and 11. It makes no difference which rail is positioned above which locking member or which end of the tie is up or down. Thus, while the foregoing discussion assumes that rail 52 is positioned above locking member 10 and rail 53 is positioned above rail locking member 11, the opposite could be the case.

More specifically, connecting member 58 is aligned with gap 26 and connecting member 59 is aligned with gap 27. Further, the outer rail member 54 is aligned with the channels formed by the recesses/cavities 30 and 34 in the teeth of the first row of teeth 22 and the second row of teeth 24 of locking member 10, and the outer rail member 55 is aligned with the channels formed by the recesses/cavities 31 and 35 in the teeth of the first row of teeth 23 and the second row of teeth 25 of locking member 11.

When the first locking member 10, second locking member 11 and the tie 50 are so aligned, the tie 50 can then be slid downwardly and into a locked position. In the locked position, the first rail 52 is coupled to the first locking member 10 because: (a) outer rail member 54 resides in the recesses 30 of the teeth of the first row of teeth 22 and in the recesses 34 of the second row of teeth 24, (b) the connecting member 58 is in the gap 26, (c) the inner rail member 56 is in face-to-face registration with the inner surfaces 28 of the first row of teeth 22 and the inner surfaces 32 of the second row of teeth 24, and (d) and the locking tabs 60 are in engagement with the notches 38 in the end teeth 36 of the first row of teeth 22 and notches 42 in the end teeth 40 of the second row of teeth 24. In the locked position, the second rail 53 is coupled to second locking member 11 because: (a) outer rail member 55 resides in the recesses 31 of the teeth of the first row of teeth 23 and in the recesses 35 of the second row of teeth 25, (b) the connecting member 58 is in the gap 27, (c) the inner rail member 57 is in face-to-face registration with the inner surfaces 29 of the first row of teeth 23 and the inner surfaces 33 of the second row of teeth 25, and (d) the locking tabs 61 are in engagement with the notches 39 in the end teeth 37 of the first row of teeth 23 and notches 43 in the end teeth 41 of the second row of teeth 25.

Of course, the embodiment of the present invention described above also permits the tie 50 to be joined to the locking member embedded in one of the panels, and separately and subsequently joined to the locking member embedded in a second of the panels. Likewise, in certain situations it may be beneficial to join the locking members to the ties and then form the panels about the locking members.

In some situations, a form of a different size may be required, such as to provide spaces in the concrete wall for doors or windows of a building. While this may be accommodated by using panels, locking members and ties of different lengths, in some instances is desirable to cut the panels to size in the field. To facilitate this, the locking members 10 and 11 and rails 52 and 53 may be provided with a score, i.e., a reduced thickness at one or more points (such as the midpoint) along their length. See, e.g., scores 62 and 63. When the rails 52 and 53 of the tie 50 are scored, bridging member 64 is positioned on one side of the score and bridging member 66 is positioned on the other side of the score. Also, the desired thickness of the concrete may change. To facilitate this, ties 50 having bridging members 64 and 66 of different lengths may be provided to vary the distance between the inside surfaces 72 and 73 of the panels 70 and 71 to provide the desired predetermined distance 80 between the inside surfaces 72 and 73 of the panels 70 and 71.

Figure 22:
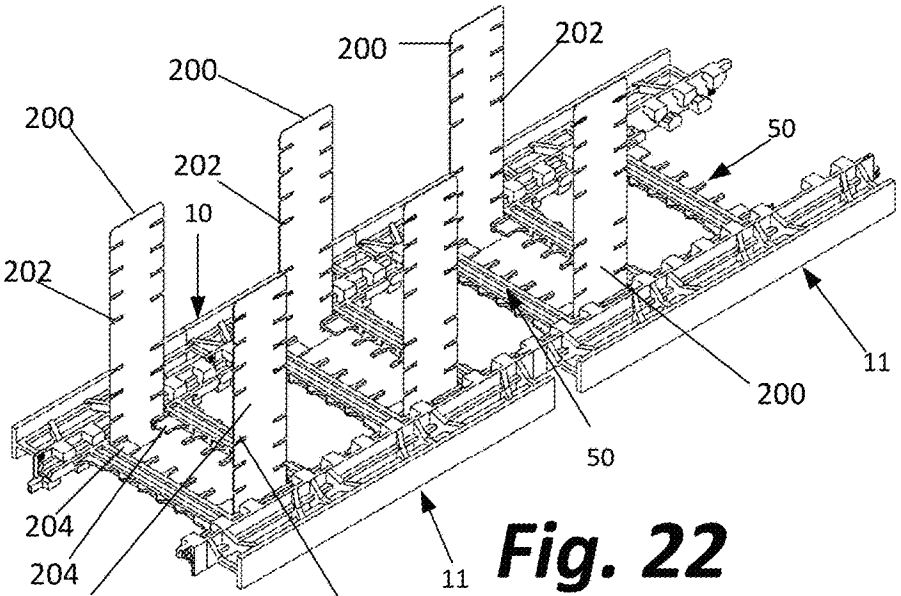
FIG. 22 is a perspective view shows the assembly of FIG. 19 coupled to a plurality of slotted plates.
Figure 24:
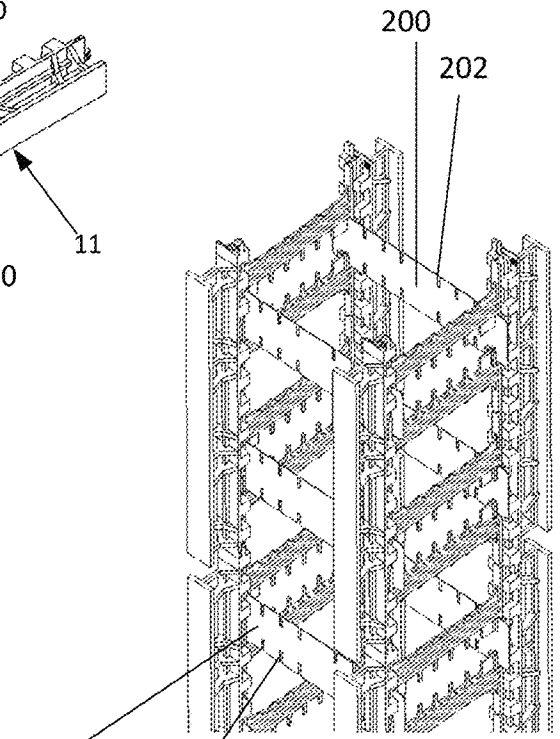
FIG. 24 is another perspective view of the assembly shown in FIG. 23.
Figure 23:
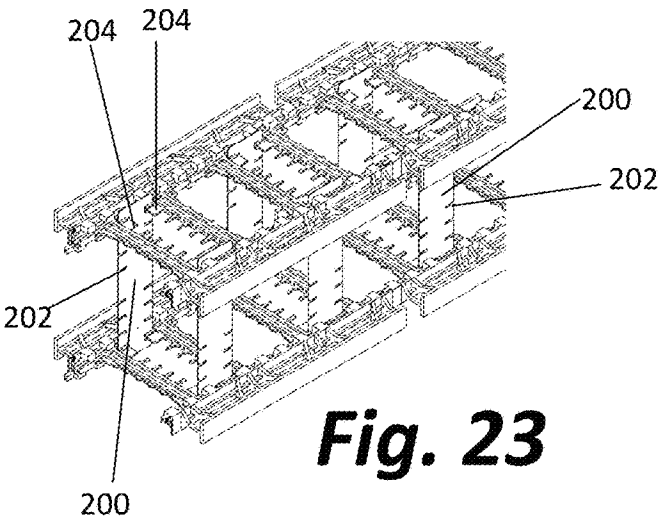
FIG. 23 is a perspective view showing two assemblies like that shown in FIG. 19 coupled together by the plates shown in FIG. 22.
Figure 25:
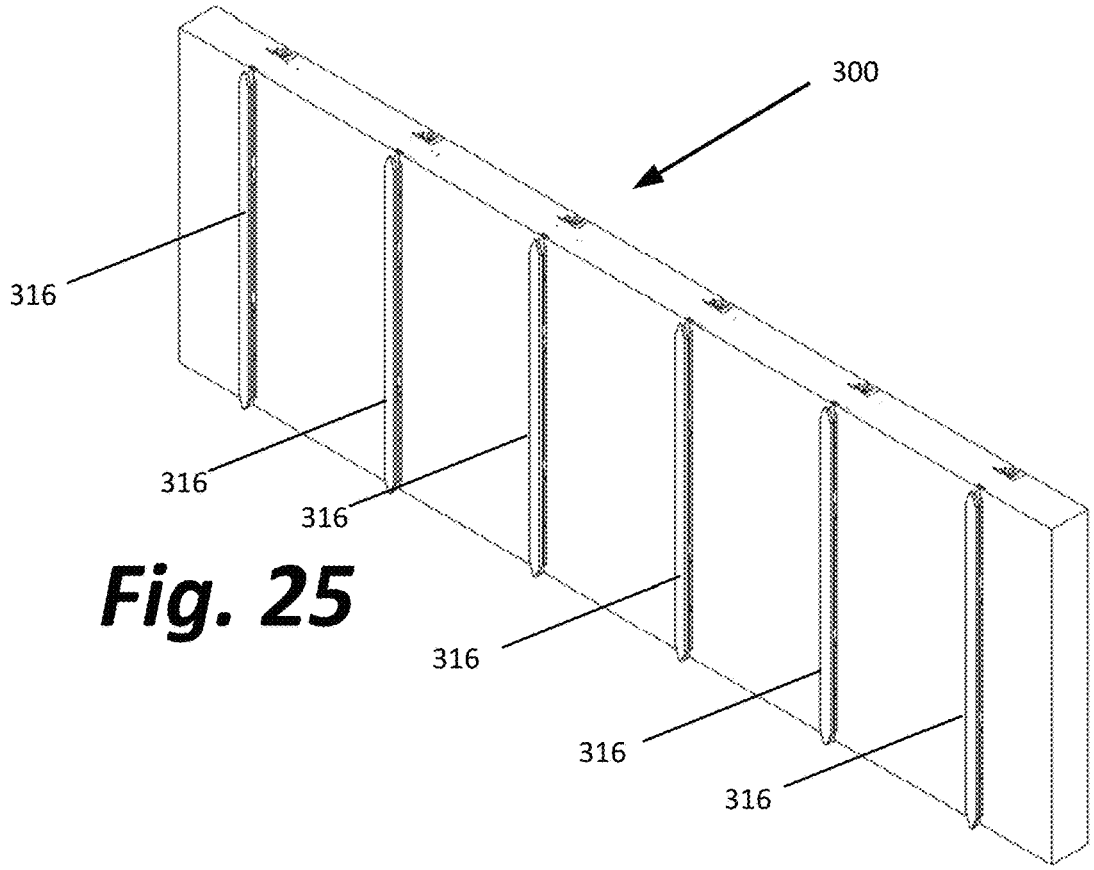
FIG. 25 is a perspective view showing the front of an alternative embodiment of a first panel adapted to be joined in face-to-face contact with a second panel of the same design as the first panel to achieve enhanced insulative performance.
Figure 26:
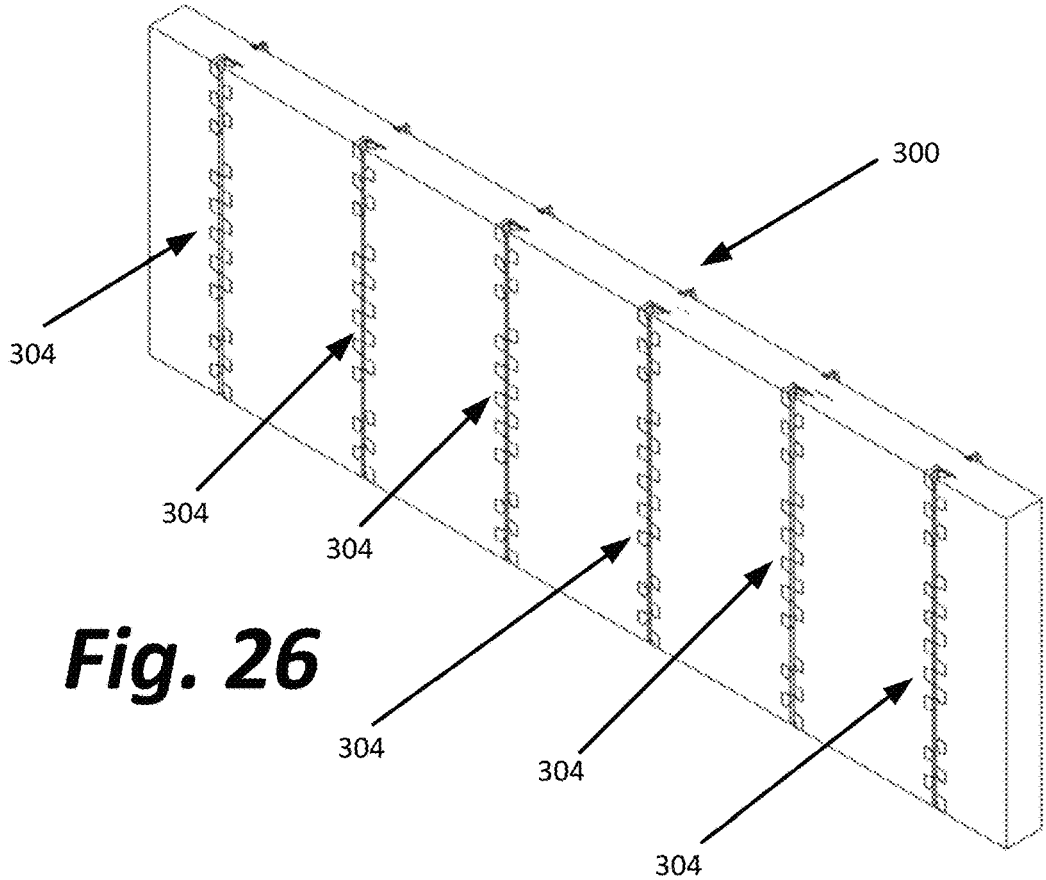
FIG. 26 is a perspective view showing the rear of the panel of FIG. 25.
Figure 27:
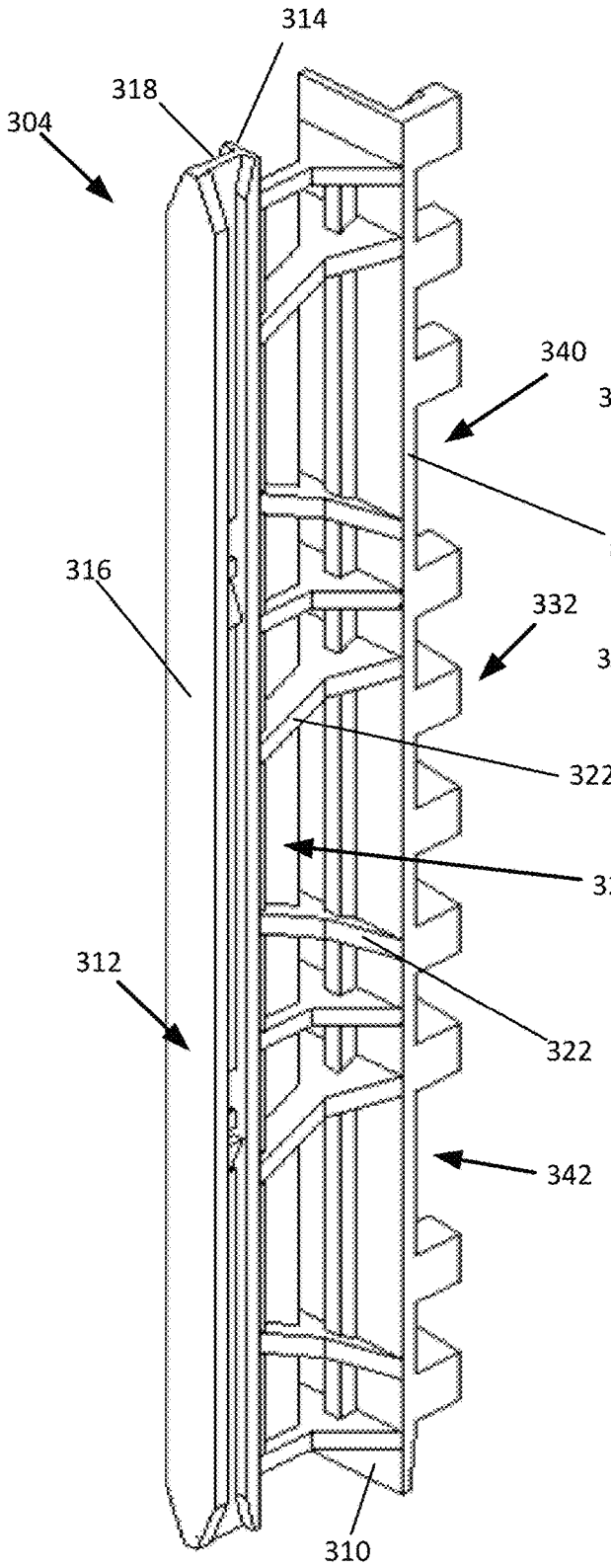
FIG. 27 is a perspective view of the locking member employed in the construction of the panel of FIG. 25.
Figure 28:
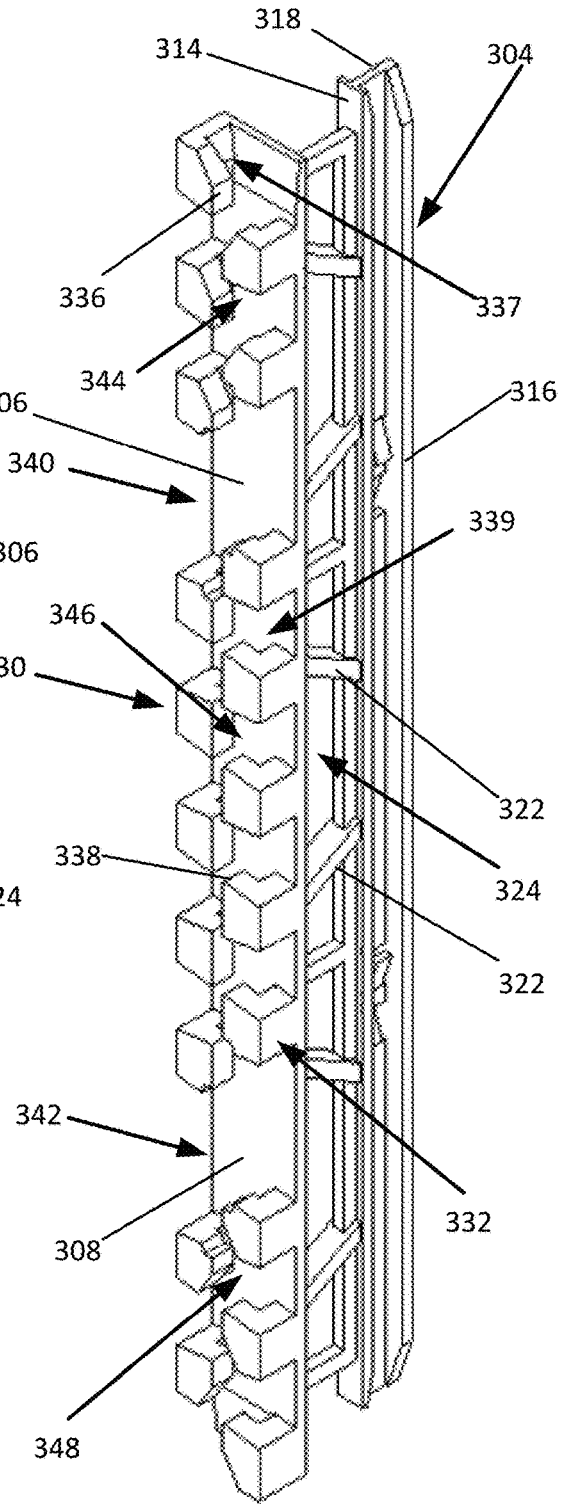
FIG. 28 is a second perspective view of the locking member employed in the construction of the panel of FIG. 25.
Figure 29:
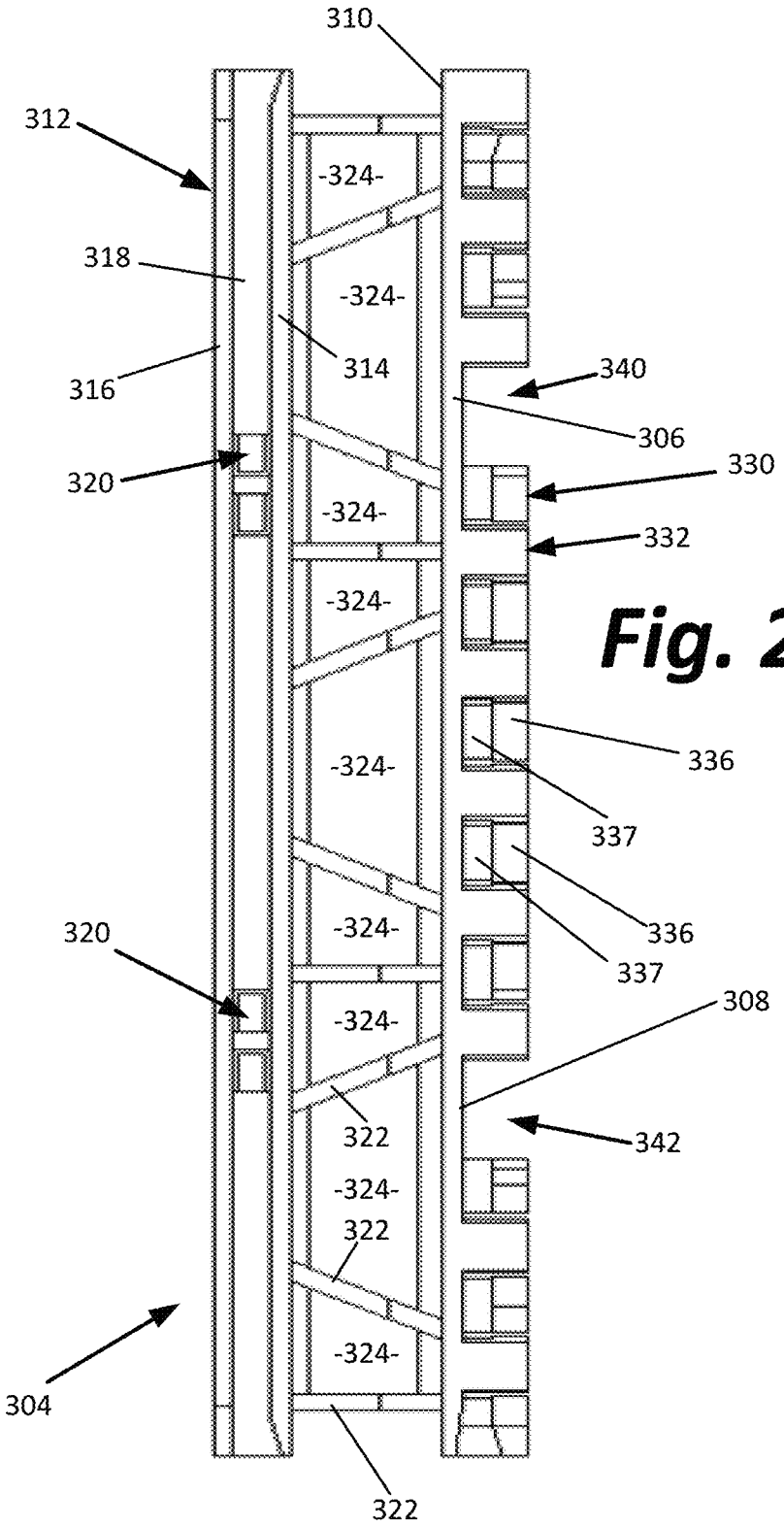
FIG. 29 is a side view of the locking member employed in the construction of the panel of FIG. 25.

Also, it is quite common to reinforce concrete with rebar. To facilitate placement and retention of rebar in the proper orientation within the form, the bridging members 64 and 66 are provided with concave pathways 65/67 adapted to allow sections of rebar to be supported by the bridging members 64/66 at various positions along the length of the bridging members 64/66. Further, plates 200 having slots 202 may be used instead of or in addition to rebar as shown in FIGS. 22-24. The slots 202 are adapted to receive and frictionally engage the bridge tabs 204 defining the concave pathways to hold the plates 200 in position as the forms are assembled, the concrete is poured, and the concrete cures.

Various other modifications may be made to enhance the versatility of the locking members 10 and 11, and the ties 50.

Figure 16:
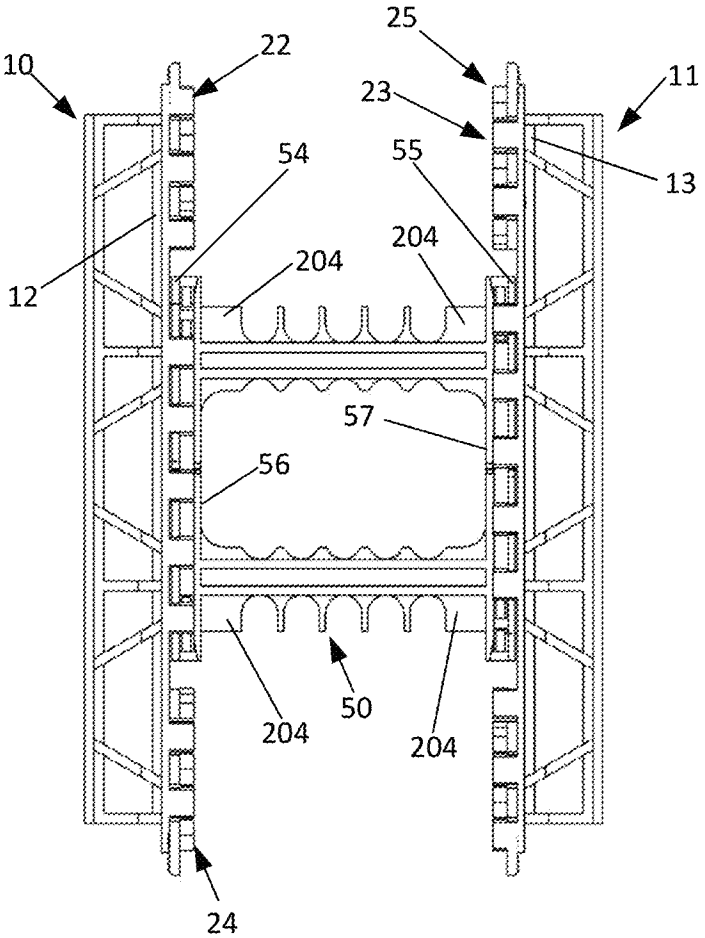
FIG. 16 is a plan view showing an assembly comprising alternative locking members each having rows of teeth extending substantially their entire length.
Figure 18:
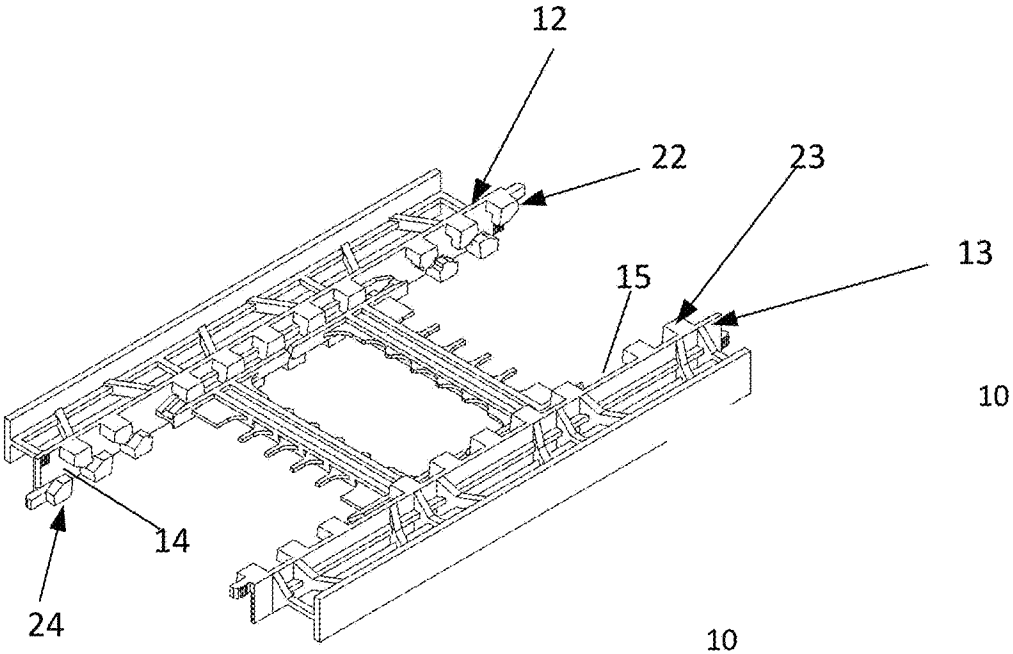
FIG. 18 is a perspective view of the assembly of FIG. 16.

For example and as shown in FIGS. 16-19, the number of teeth of the first row of teeth 22 and of the second row of teeth 24 on the inside surface of 14 of the inner plate 12, and the number of teeth of the first row of teeth 23 and of the second row of teeth 25 on the inside surface of 15 of the inner plate 13, may be expanded so these rows of teeth extend substantially the entire length of the inside surfaces 14/15 of the inner plates 12/13. More specifically, and as shown in FIGS. 16 and 18, the teeth are divided into three groups, a center group having teeth of a first design and two end groups having teeth of a design that allows a center tie to pass across one of the end groups so that the center tie is only captured in position by the center group of teeth. Providing three groups allows for additional ties 50 to be attached between the locking members 10 and 11 providing a stronger assembly.

Figure 19:
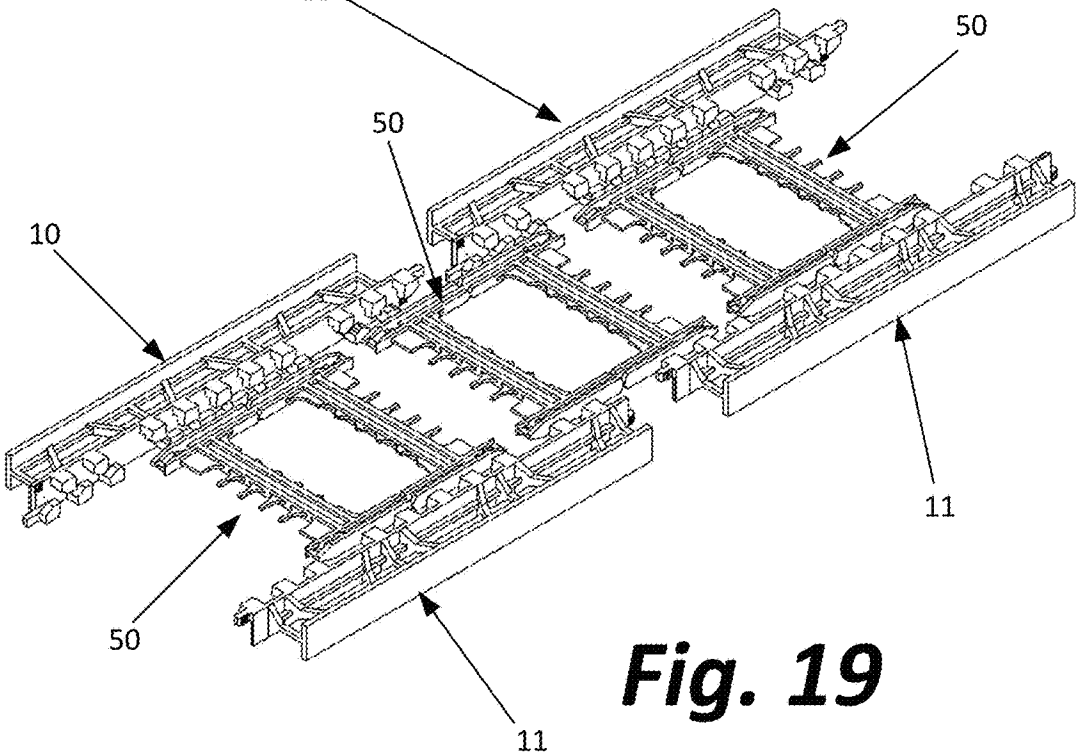
FIG. 19 is an exploded view of the assembly of FIG. 17.

Having the rows of teeth extend the entire length of the locking members 10 and 11 provides additional advantages. For example, doing so permits a larger form to be created using pairs of locking members 10 and pairs of locking members 11 arranged end to end and a tie 50 inserted to span the connection between the two locking members 10 and the two locking members 11 thereby fastening all four of these locking members together as shown in FIGS. 17, 19, and 22-24. More specifically, and as best illustrated in FIGS. 19 and 22, two locking members 10 are aligned end-to-end and the two adjacent ends of the two locking members 10 are brought together to form a first abutment. Likewise, two locking members 11 are aligned end-to-end and the two adjacent ends of the two locking members 11 are brought together to form a second abutment. A tie 50 is inserted to span the first and second abutments thereby locking the two locking members 10 together, the two locking members 11 together, and the pair of locking members 10 together with the pair of locking members 11. Additional ties 50 may be incorporated into the assembly for added strength.

Ninety-degree corners have traditionally been a weak spot in prior art insulated concrete form systems. The present invention offers a clear opportunity to strengthen ninety-degree corners. More specifically, the locking members of each pair of locking members are embedded in separate panels. Using the ties 50 to span the first and second abutments provides an effective way to create multiple courses of such panels 70/71. The ties 50, when employed in this manner, not only lock four panels together side to side and top to bottom, but also dramatically increases the form capacity strength of the assembly of such panels to better withstand the concrete pressures during the concrete pour.

Figure 21:
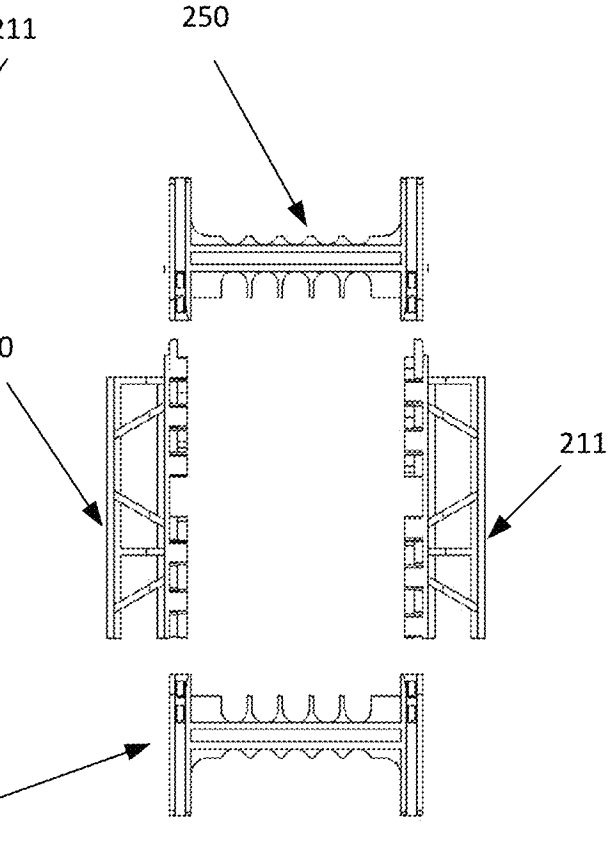
FIG. 21 is an exploded view of the assembly shown in FIG. 20.
Figure 20:
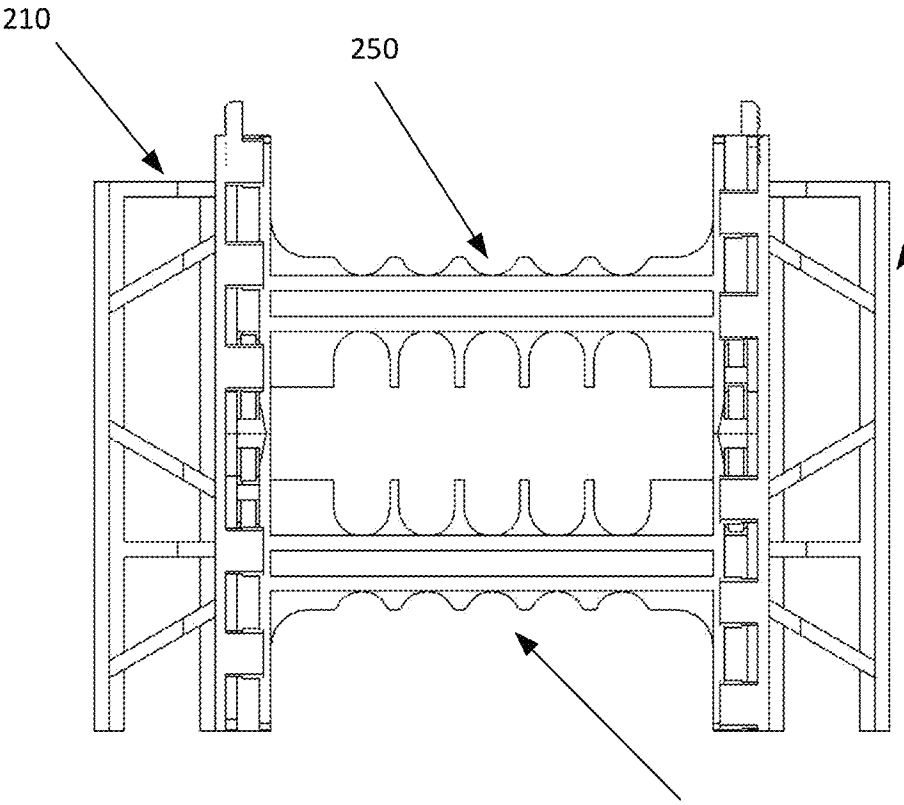
FIG. 20 is a plan view of an assembly comprising two halves of one of the alternative locking members of FIG. 16 and two halves of a bridging member.

As noted above, in some situations a form of a smaller size may also be desired. This is easily accommodated in the field by scoring the rails 52/53 of the ties 50. See scores 62 and 63. This allows a tie 50 to be easily split in two halves 250 and 251 as shown in FIG. 21. As also shown in FIGS. 20 and 21, when the rows of teeth extend the entire length of the inside surfaces of the inner plates of the locking members 10/11, these locking members may also be split into two sections 210 and 211. A form half as tall may be created using two of the halflocking members 210 and 211 and both halves 250 and 251 of the tie 50. As shown in FIG. 21, a first half 250 of the tie 50 can be inserted from the first end of the pair of half locking members 210 and 211, and the other half 251 of the tie 50 can be inserted from the other end of the pair of half locking members 210 and 211. This provides a fully locked arrangement because, the locking tabs 60/61 of each half of the tie 50 prevent the half ties 250 and 251 from being extracted from the same end of its insertion into the half locking members 210 and 211 and the two half ties 250 and 251 will butt up against each other as shown in FIG. 20 preventing either of the two half ties 250/251 from sliding all the way through the half locking members 210 and 211 and out the other end.

It may prove desirable in certain situations to increase the insulative value provided by the forms. FIGS. 25 through 32 show an alternative embodiment in which two panels 300 and 302 are placed in face-to-face registration and contact with each other to increase the thickness of the form increasing its R-value. This is achieved by using locking members 304 of the type shown in FIGS. 27-29.

The locking members 304, like the locking members 10/11, have an inner plate 306. The inner plate 306 has an inside surface 308 and an outside surface 310. The locking members 304 also have an I-beam 312 comprising a first plate 314 and a second plate 316 connected by a center plate 318. Detents or locking tabs 320 project from the center plate of the I-beam 312. The inner plate 306 and the first plate 314 of the I-beam 312 are fixed together in a parallel spaced relation by a series of struts 322. More specifically, the struts 322 are coupled at one end to the first plate 314 at another end to the outside surface 310 of the inner plate 306.

The struts 322, the first plate 314 and the inner plate 306 combine to define a series of spaces 324.

Two rows of teeth project from the inside surface 308 of the inner plate 306. As shown in the drawings, inside surface 308 has a first row of teeth 330 and a second row of teeth 332 separated by a gap 334.

Each of the teeth have certain features in common. All the teeth have an inner surface. More specifically, locking member 324 has a first row of teeth 330 having inner surfaces 336, and a second row of teeth 332 having inner surfaces 338.

Each tooth also includes a recess or cavity positioned between the inside surface of the inner plate and the inner surface of the tooth. More specifically, each tooth of first row 330 has a recess 337 between the inside surface 308 of inner plate 306 and the inner surface 336 of the tooth, and each tooth of second row 332 has a recess 339 between the inside surface 308 of the inner plate 306 and the inner surface 338 of the tooth. It is important to note that the recesses 337 in the teeth of the first row of teeth 330 are open toward the second row of teeth 332. Likewise, the recesses 339 in the teeth of the second row of teeth 332 are open toward the first row of teeth 330. Further, the teeth of the first row of teeth 330 are offset from the teeth of the second row of teeth 332. In other words, the teeth of one row are aligned with spaces between the teeth of the other row.

Figure 31:
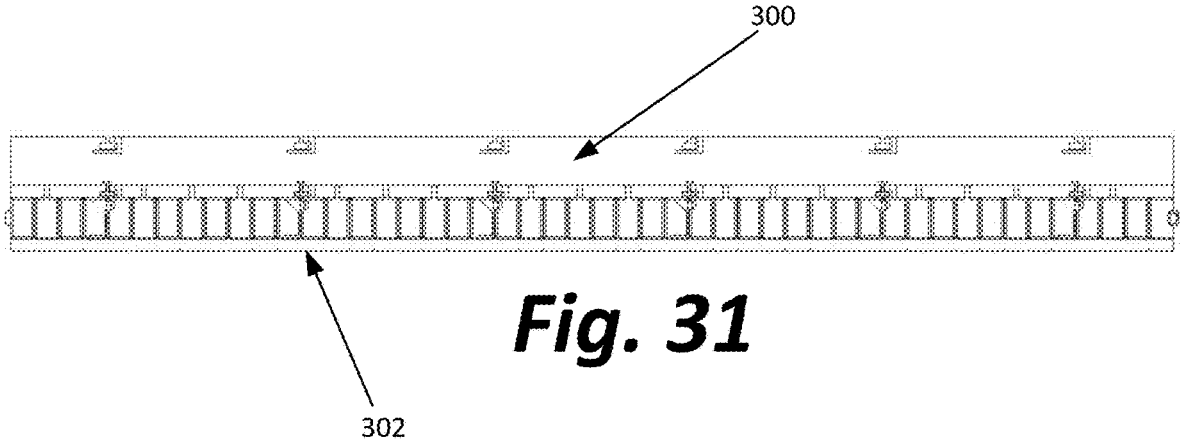
FIG. 31 is a top view of two panels of the type shown in FIG. 25 joined together in face-to-face contact.
Figure 32:
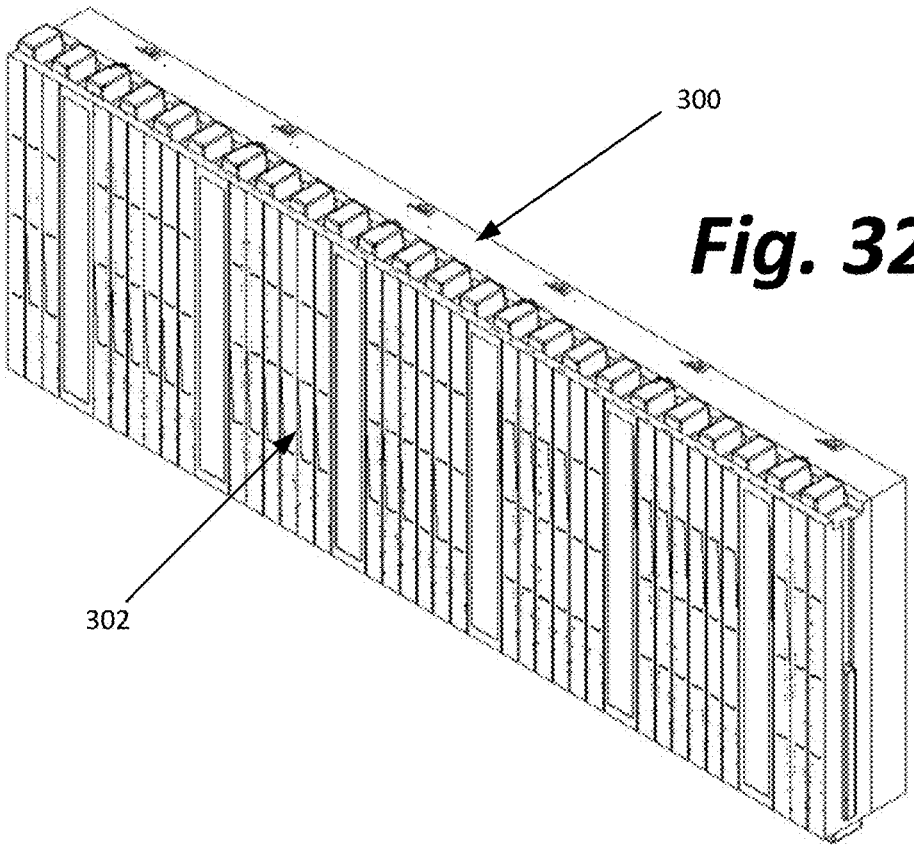
FIG. 32 is a perspective view of two panels of the type shown in FIG. 25 joined together in face-to-face contact.

As shown in FIGS. 31 and 32, the teeth are arranged in three groups, a middle group and two end groups. The groups are separated by voids 340 and 342 which are larger than the gaps between the teeth of a particular group. The groups thus form three separate channels, specifically a center channel 346 and two end channels 344 and 348. The primary function of the middle group and center channel 346 is to assist in connecting two panels in parallel face-to-face registration (either as shown in FIGS. 31 and 32 or as shown in FIG. 1) while the primary function of the end groups and the two end channels 344 and 348 is to assist when connecting two panels end to end (as shown in FIGS. 22-24). More specifically, the center channel is used like the channel of FIGS. 1-15. The end channels are used to couple layers of blocks formed by the panels together as a stack.

Figure 30:
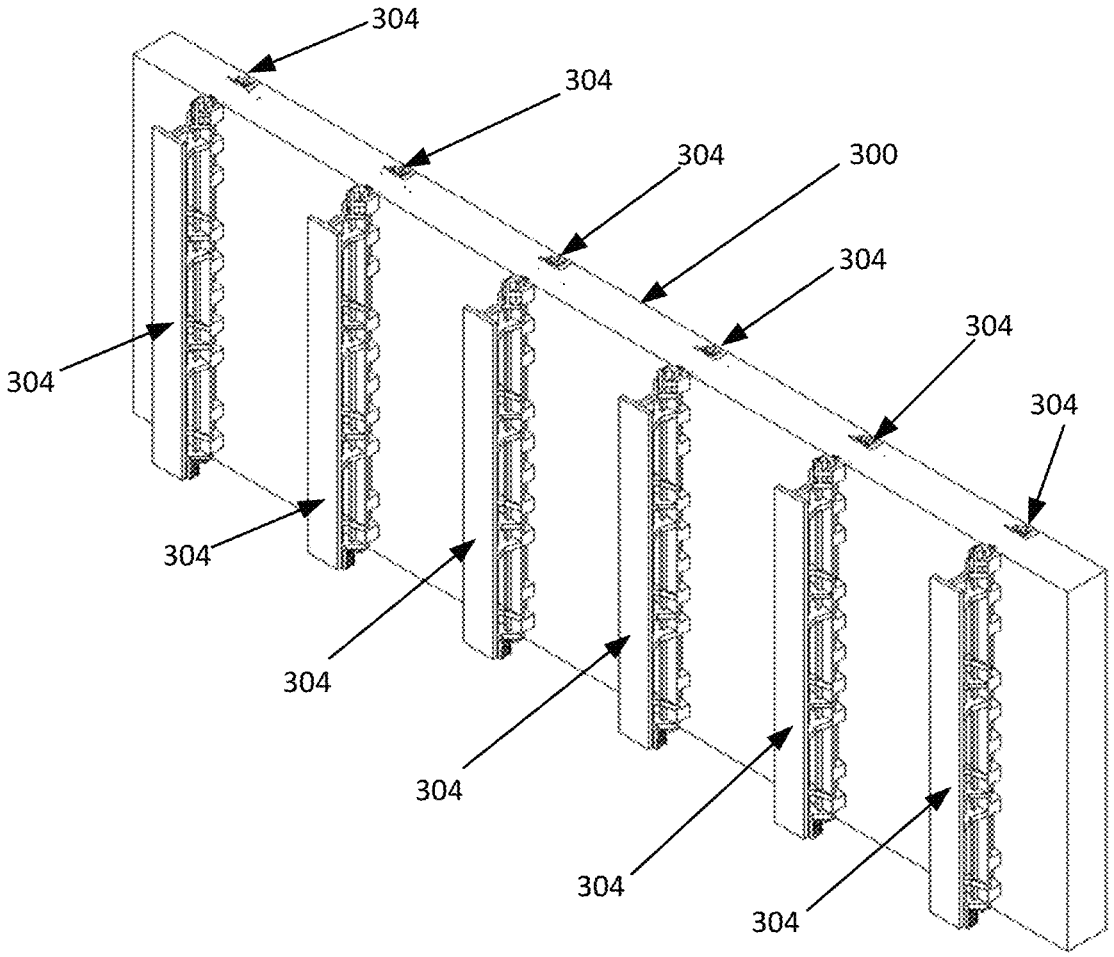
FIG. 30 is a perspective view of the panel of FIG. 25 with the locking member of a second panel joined thereto.

When it is desired to provide panels that can be assembled in face-to-face registration and contact to increase the R-value of the form, the panels are formed with the second plate 316 of the I-beam exposed as shown in FIG. 30. Two panels can then be coupled together by sliding the second plate 316 of the I-beam of one panel, e.g., panel 300, into at least the center channel 346 formed by teeth of a second panel, e.g., panel 302 as illustrated in FIGS. 31 and 32. The detents 320 of one panel engage teeth of the other panel to lock the two panels 300 and 302 together. When so engaged, they prevent further sliding of the panels relative to each other. To increase the R-value (insulative properties) even further, additional panels can be joined to panels 300 and 302 in the same fashion. To create a block, other panels may be joined to the assembly of panels 300/302 using ties as described above.

Figure 33:
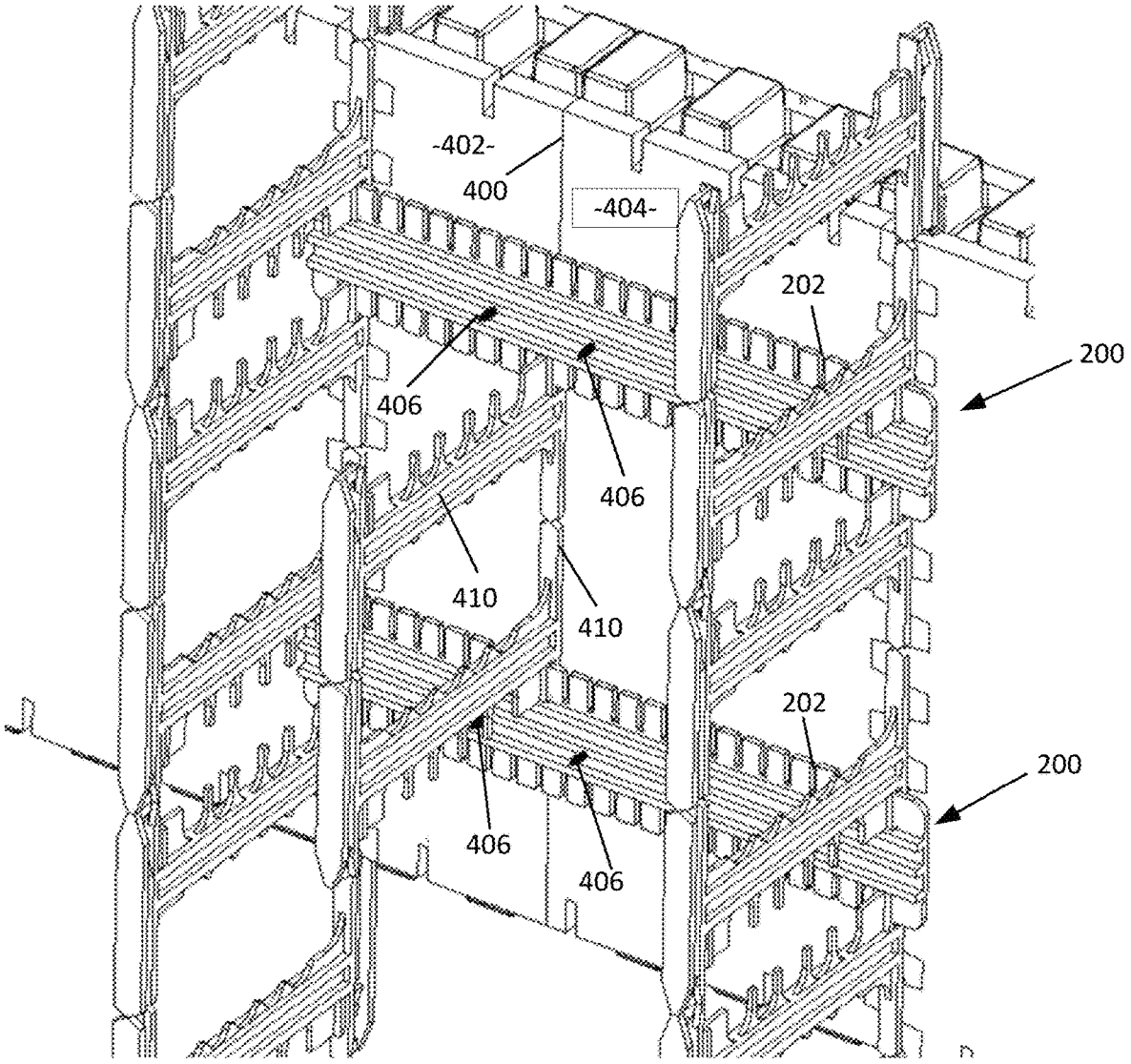
FIG. 33 is a perspective view of still another alternative embodiment showing the use of screws, washers and secondary ties to strengthen a concrete form assembly like that show FIGS. 23 through 25.
Figure 34:
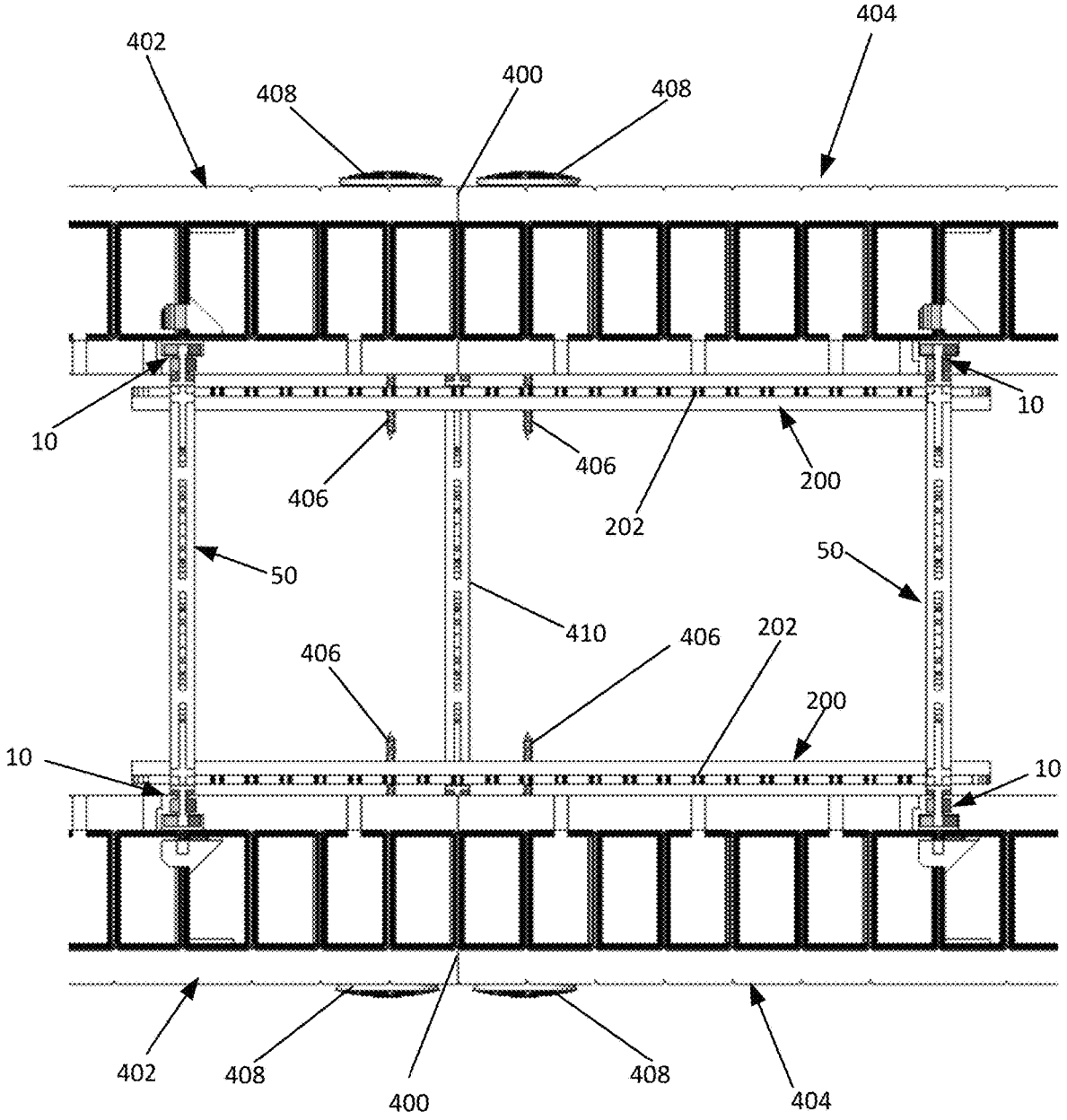
FIG. 34 is a top view of the alternative embodiment of FIG. 33.

FIGS. 33 and 34 show in greater detail advantages derived from the use of the plates 200 shown in FIGS. 22 through 24. As shown in FIGS. 33 and 34, one or more plates 200 can be coupled to ties 50 so the plates 200 span the abutment 400 between two panels 402 and 404 arranged end to end. Screws 406 may then be inserted through each of the abutted panels 402 and 404 adjacent the abutment 400 and into the plates 200. These serve to reduce the possibility of the panels 402 and 404 deflecting at the abutment 400 when concrete is poured into the form. Note that washers 408 are provided to prevent the heads of the screws 406 from tearing through the foam of the panels 402 and 404.

Additionally, plates 200 may be used to mount secondary ties 410 at locations when there is no locking member embedded in a panel. Such secondary ties 410 are adapted to mate with and be held in place by the slots 202 of the plates 200.

This invention has been described herein in considerable detail to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A concrete form assembly comprising a first locking member, said first locking member having: (i) a first plate, (ii) an I-beam comprising a second plate and a third plate held together by a connecting plate, (iii) a plurality of struts extending between the first plate and the second plate holding the first plate and I-beam in spaced relation relative to each other, said struts defining a plurality of spaces, and (iv) a plurality of teeth projecting from the first plate and arranged in two rows, each of said two rows separated from each other by a space, each of said plurality of teeth having a recess open toward the space.

2. The concrete form assembly of claim 1 wherein said plurality of teeth projecting from the first plate are arranged in three groups consisting of a middle group and two end groups.

3. The concrete form assembly of claim 1 wherein said first locking member is imbedded in a first foam panel with at least the third plate and the teeth of the first locking member exposed and the plurality of spaces of the first locking member defined by the struts of the first locking member filled with foam.

4. The concrete form assembly of claim 3 further comprising a second locking member having: (i) a first plate, (ii) an I-beam comprising a second plate and a third plate held together by a connecting plate, (iii) a plurality of struts extending between the first plate of the second locking member and the second plate of the second locking member holding the first plate of the second locking member and I-beam of the second locking member in spaced relation relative to each other, said struts defining a plurality of spaces, and (iv) a plurality of teeth projecting from the first plate of the second locking member and arranged in two rows, each of said two rows separated from each other by a space, each of said plurality of teeth having a recess open toward the space, said second locking member imbedded in a second foam panel with at least the third plate of the second locking member and the teeth of the second locking member exposed and the plurality of spaces of the second locking member defined by the struts of the second locking member filled with foam.

5. The concrete form assembly of claim 4 wherein the first and second panels are adapted to be joined together in direct contact with each other by positioning the third plate of the second locking member in the recesses of the teeth of the first locking member and the connecting plate of the second locking member in the space between the two rows of teeth of the first locking member.

6. The concrete form assembly of claim 5 further including at least one detent adapted to hold the third plate of the second locking member in the recesses of the teeth of the first locking member and the connecting plate of the second locking member in the space between the two rows of teeth of the first locking member.

7. The concrete form assembly of claim 4 further comprising a first tie, said first tie comprising first and second rails connected and held in spaced, parallel relation to each other by first and second bridging members, each of said first and second rails having: (i) a first rail member, (ii) a second rail member, and (iii) a connecting member.

8. The concrete form assembly of claim 7 wherein said first rail of said first tie is adapted to be coupled to the first locking member and said second rail of said first tie is adapted to be coupled to the second locking member such that the first tie holds the first and second locking members a predetermined distance from each other.

9. The concrete form assembly of claim 8 wherein when the first rail of said first tie is coupled to the first locking member, the first rail member of the first rail resides in the recesses of the teeth of the first locking member and the connecting member of the first rail resides in the space between the two rows of teeth of the first locking member.

10. The concrete form assembly of claim 9 wherein when the second rail of said first tie is coupled to the second locking member, the first rail member of the second rail resides in the recesses of the teeth of the second locking member and the connecting member of the second rail resides in the space between the two rows of teeth of the second locking member.

11. The concrete form assembly of claim 3 further comprising a second locking member and a third locking member, each of said second and third locking members having: (i) a first plate, (ii) an I-beam comprising a second plate and a third plate held together by a connecting plate, (iii) a plurality of struts extending between the first plate and the second plate holding the first plate and I-beam in spaced relation relative to each other, said struts defining a plurality of spaces, and (iv) a plurality of teeth projecting from the first plate and arranged in two rows, each of said two rows separated from each other by a space, each of said plurality of teeth having a recess open toward the space and an inside surface, said second locking member imbedded in a second foam panel with at least the third plate and the teeth of the second locking member exposed and the plurality of spaces of the second locking member defined by the struts of the second locking member filled with foam, said third locking member imbedded in a third foam panel with at least the third plate and the teeth of the third locking member exposed and the plurality of spaces of the third locking member defined by the struts of the third locking member filled with foam.

12. The concrete form assembly of claim 11 wherein the first and second panels are adapted to be joined together in direct contact with each other by positioning the third plate of the second locking member in the recesses of the teeth of the first locking member and the connecting plate of the second locking member in the space between the two rows of teeth of the first locking member.

13. The concrete form assembly of claim 12 further comprising a first tie, said first tie comprising first and second rails connected and held in spaced, parallel relation to each other by first and second bridging members, each of said first and second rails having: (i) a first rail member, (ii) a second rail member, and (iii) a connecting member.

14. The concrete form assembly of claim 13 wherein said first rail of said first tie is adapted to be coupled to the second locking member and said second rail of said first tie is adapted to be coupled to the third locking member such that the first tie holds the second and third locking members a predetermined distance from each other.

15. The concrete form assembly of claim 14 wherein when the first rail of said first tie is coupled to the second locking member, the first rail member of the first rail resides in recesses of the teeth of the second locking member and the connecting member of the first rail resides in the space between the two rows of teeth of the second locking member.

16. The concrete form assembly of claim 15 wherein when the second rail of said first tie is coupled to the third locking member, the first rail member of the second rail resides in the recesses of the teeth of the third locking member and the connecting member of the second rail resides in the space between the two rows of teeth of the third locking member.

17. A concrete form assembly comprising a first locking member, a second locking member and a third locking member, each of said first locking member, said second locking member and said third locking member having: (i) a first end and a second end, (ii) a first plate, (iii) an I-beam comprising a second plate and a third plate held together by a connecting plate, (iv) a plurality of struts extending between the first plate and the second plate holding the first plate and I-beam in spaced relation relative to each other said struts defining a plurality of spaces, (v) a plurality of teeth projecting from the first plate and arranged in two rows, each of said two rows separated from each other by a space, each of said plurality of teeth having a recess open toward the space and an inside surface.

18. The concrete form assembly of claim 17 wherein said first locking member is imbedded in a first foam panel with at least the third plate and the teeth of the first locking member exposed and the plurality of spaces of the first locking member defined by the struts of the first locking member filled with foam, wherein said second locking member is imbedded in a second foam panel with at least the third plate and the teeth of the second locking member exposed and the plurality of spaces of the second locking member defined by the struts of the second locking member filled with foam, and wherein said third locking member is imbedded in a third foam panel with at least the third plate and the teeth of the third locking member exposed and the plurality of spaces of the third locking member defined by the struts of the third locking member filled with foam.

19. The concrete form assembly of claim 18 wherein the first and second panels are adapted to be joined together in direct contact with each other by positioning the third plate of the second locking member in recesses of teeth of the first locking member and the connecting plate of the second locking member in the space between the two rows of teeth of the first locking member.

20. The concrete form assembly of claim 19 further comprising a first tie, said first tie comprising first and second rails connected and held in spaced, parallel relation to each other by first and second bridging members, each of said first and second rails having: (i) a first rail member, (ii) a second rail member, (iii) a connecting member, wherein said first rail of said first tie is adapted to be coupled to the second locking member and said second rail of said first tie is adapted to the coupled to the third locking member such that the first tie holds the second and third locking members a predetermined distance from each other, wherein when the first rail of said first tie is coupled to the second locking member, the first rail member of the first rail resides in recesses of teeth of the second locking member and the connecting member of the first rail resides in the space between the two rows of teeth of the second locking member, and wherein when the second rail of said first tie is coupled to the third locking member, the first rail member of the second rail resides in recesses of teeth of the third locking member and the connecting member of the second rail resides in the space between the two rows of teeth of the third locking member.

* * * * *